US006926488B1

(12) United States Patent
Bolding et al.

(10) Patent No.: US 6,926,488 B1
(45) Date of Patent: Aug. 9, 2005

(54) HORIZONTAL DRILL PIPE RACKER AND DELIVERY SYSTEM

(75) Inventors: Vance E. Bolding, Katy, TX (US); Andrew J. Brooks, III, League City, TX (US); Michael D. Keen, Houma, LA (US)

(73) Assignee: Global Marine Inc., Houston, TX (US)

( * ) Notice: Subject to any disclaimer, the term of this patent is extended or adjusted under 35 U.S.C. 154(b) by 62 days.

(21) Appl. No.: 10/089,577

(22) PCT Filed: Sep. 29, 2000

(86) PCT No.: PCT/US00/27043

§ 371 (c)(1),
(2), (4) Date: Mar. 29, 2002

(87) PCT Pub. No.: WO01/23701

PCT Pub. Date: Apr. 5, 2001

Related U.S. Application Data

(60) Provisional application No. 60/156,662, filed on Sep. 29, 1999.

(51) Int. Cl.[7] ..... E21B 19/00

(52) U.S. Cl. ..... 414/22.62; 414/22.54; 414/22.57; 414/22.59; 211/70.4

(58) Field of Search ..... 211/70.4; 414/22.54, 414/22.57, 22.59, 22.62

(56) References Cited

U.S. PATENT DOCUMENTS 3,083,842 A 4/1963 Bauer et al.
3,145,786 A * 8/1964 O'Neill et al. ..... 175/85
3,193,084 A 7/1965 Bauer et al.
3,612,286 A * 10/1971 Langowski et al. ..... 211/70.4
3,616,941 A * 11/1971 Walling ..... 414/746.2
3,844,420 A * 10/1974 Walling et al. ..... 414/746.2
3,870,165 A * 3/1975 Besijn ..... 414/22.71
3,887,086 A * 6/1975 Woolslayer et al. ..... 414/22.54
3,978,994 A * 9/1976 Woolslayer et al. ..... 414/22.62
4,439,091 A * 3/1984 Frias ..... 414/22.59

* cited by examiner

*Primary Examiner*—Khoi H. Tran
(74) *Attorney, Agent, or Firm*—Christie, Parker & Hale, LLP

(57) ABSTRACT

Stands (43) of multiple lengths of drill pipe, for oil and gas drilling are individually supported in a storage bin (28, 29) in an array of plural layers of plural numbers of stands. The individual stands are held in cooperating notches (41, 42) in vertically aligned support sleepers (38, 39) so that each stand experiences loads due only to its own weight and motions of a bin frame (13) where, as preferred, the frame is supported on a drillship deck (12). Sleepers between stand layers are indexable between positions in the array and outside the array. A bridge crane (32, 33) spans the length of the bin and is moveable transversely above it. The bridge crane carries vertically movable magnetic lifting heads (47) for lifting, holding and releasing an individual pipe stand. The crane can move a stand between a supported position in the bin array and a supported position on a power-driven carriage (18, 49) which is movable along a path along an upper part of a side of the bin (28, 29). The carriage includes a skate cart (18) for transporting a stand as such, and a pin cart (49) drivable along the skate cart for supporting the pin end of a stand on the skate. The carriage path preferably ends inside the margin of the floor (17) of a drilling rig.

55 Claims, 20 Drawing Sheets

45
11
33
67
67
32
31
44
26
52
27
47
18
69
69
19
28
25(G)
25(H)
45
25(J)
29
46
47
24

52
76
78
70
18
49
75
77
71
19
69
79

25
38
65
54
59
57
62
11A
61
56
55
64
34
58
63
60

80
82
135
136
132
82
136
73
130
70
19

80
82
135
132
135
82
73
136
82
130
70
19

45
129
129
46
113
115
116
112
114
118
118
120
109
109
105
105
107
107
101
47

HORIZONTAL DRILL PIPE RACKER AND DELIVERY SYSTEM

This application claims benefit of U.S. Provisional Appl. No. 60/156,662, filed Sep. 29, 1999.

FIELD OF THE INVENTION

This invention pertains to structures and procedures for horizontally storing drill pipe adjacent to and preferably below the level of the drill floor of a well drilling installation. It also pertains to structures and procedures for moving stands of drill pipe between their storage locations and the drill floor.

BACKGROUND OF THE INVENTION

The quest for new oil reserves by the world oil industry forces the industry to seek oil and gas reserves in increasingly more demanding environments including the deep ocean. As the water depth for offshore drilling increases, the size of the equipment required to perform the drilling operations increases, as does the amount of subsea equipment required to extend the well bore to the surface of the ocean. Correspondingly, the costs of the equipment and of the drilling operation increase. A desirable way to offset the increased operating costs resulting from the use of current technology is to increase operating efficiency. An effective way to improve efficiency is to perform operations in less time, which translates into faster operating rates.

Drill pipe is one of the items affected by the increase in water depth. In the early years of offshore drilling, drilling operations were performed in water depths of a few hundred feet using five-inch (12.7 cm.) drill pipe weighing twenty and one-halfpounds per linear foot (30.6 Kg./m.) including the connecting tool joints. Stands of drill pipe made up of three sections of such drill pipe, each nominally thirty-one feet (9.45 m.) in length, are called triples and weigh about one thousand nine hundred (1900) pounds (863.6 Kg). By comparison, triples for deep water drilling operations are made up of five inch (12.7 cm.) drill pipe weighing about 31 pounds per linear foot (46.3 Kg./m.), five and one-half inch (14.0 cm.) drill pipe weighing about 34 pounds per linear foot (50.8 Kg./m.), and six and five-eighths inch (16.8 cm.) drill pipe weighing up to forty-six pounds per foot (68.7 Kg./m.). The weight of drill pipe triples made up of these heavier pipes is about 2880 pounds (1309 Kg.) for the five inch drill pipe, about 3160 pounds (1436 Kg.) for the five and one-half inch drill pipe, and about 4300 pounds (1955 Kg.) for the six and five-eighths inch drill pipe.

The drill pipe used for deep water drilling is made from low alloy steel which has been heat-treated to high strengths. The material is stressed to high levels in use and, therefore, must be maintained free from significant scratches, gouges and other imperfections which can act as stress risers. To get the maximum life out of drill pipe, it must be protected from being scratched and gouged while it is being handled between a pipe storage location and the drill string where it is used. Drill pipe which is damaged beyond rigorous low damage limits must be discarded.

Horizontal pipe rackers commonly are used in floating offshore drilling rigs, especially those of shipform configuration, because they contribute to the floating stability of the rig; they lower the position in the rig of the stored drill pipe. Horizontal pipe rackers store drill pipe triples in a horizontal position and include devices and mechanisms which transport the pipe, in either direction, between the pipe racker and the drill floor. At the drill floor, drill pipe from the racker is moved into a vertical position and is inserted into (connected to) the drill string.

Horizontal pipe rackers currently in use typically store several stands of drill pipe triples in a single bin. When the pipe is put into and removed from the bin, it is rolled down an incline to an indexing device that allows only one stand of pipe to be placed on a transporting device. The rolling produces sliding and impact loading between adjacent drill pipe triples and between drill pipe and the stationary pipe stops. While the pipe is stored in the bins, it can roll back and forth in response to the vessel's own motions thus causing wear and damage between adjacent drill pipe triples. Some pipe rackers prevent the drill pipe movement by storing each stand of pipe in a separate locking mechanism, a tactic that generally limits the drill pipe to only one size. The current method of transporting the drill pipe stands between the drill floor and the drill pipe racker involves sliding the pipe along a long trough causing further wear and scratching along the pipe where it contacts the trough.

U.S. Pat. Nos. 3,083,842 and 3,193,084 pertain to early pipe rackers, versions of which remain in use.

It is seen, therefore, that a need exists for improvements in horizontal drill pipe racking and handling systems to support deep water oil and gas drilling activities. Desirable aspects of such improvements include increased horizontal pipe storage capacity, an ability to accommodate differing diameters of drill pipe in the racker, an ability to store and to handle drill pipe stands in ways which protect the pipe surfaces from being scratched, worn or gouged, and an ability to rapidly and reliably move drill pipe stands between their storage locations and the drill floor.

SUMMARY OF THE INVENTION

This invention meaningfully addresses the needs noted above. It does so by providing structural and procedural aspects of a horizontal drill pipe racking and handling system. The system avoids the disadvantages and limitations of former horizontal pipe rackers and pipe delivery arrangements. The system possesses the above-mentioned desirable attributes and characteristics, as well as others.

The improved horizontal drill pipe racker provides positive control of the drill pipe stands at all phases of handling. The drill pipe is safely secured while stored in a bin area. Positive control of the drill pipe allows higher operating speeds to be achieved and reduces the time required to transfer drill pipe between the horizontal pipe racker and the drill floor. The time required to transfer drill pipe from the pipe racker to the drill floor is sufficiently low to keep pace with the drill floor operations.

Generally speaking a pipe storage apparatus according to this invention comprises a pipe storage bin, pipe support members for the bin, and drive mechanisms for the pipe support members. The pipe support members are horizontally disposable in the bin at plural spaced stations along the length of the bin. The pipe support members function to individually support plural horizontal lengths of drill pipe in an array of plural vertically spaced layers and of plural lengths of pipe in each layer. The pipe support drive mechanisms are selectively operable to move the support members individually between deployed positions in which the support members are in the array and retracted positions in which the support members are removed from the array.

In terms of an overall system generally, the invention provides a drill pipe storage and handling apparatus for a well drilling rig. A track extends from one end adjacent the drilling rig to an opposite end remote from the rig. An elongate carriage is adapted to travel along the track and to receive a length of drill pipe disposed longitudinally with respect to the track. A received pipe length is supported on the carriage at spaced locations along the length of the pipe. A pipe storage bin is disposed laterally of the remote end of the track. The bin includes horizontal pipe support members which are cooperatively configured for individually supporting plural lengths of drill pipe in an array of plural vertically spaced layers of pipe and plural lengths of pipe in each layer. The pipe support members above the bottom layer are indexable between deployed positions in and transversely of the array and retracted positions outside the array.

In terms of a general method for storing oil and gas well drill pipe, the method includes the step of horizontally disposing a selected number of pipe lengths, as a first bottom layer thereof, individually in upwardly open notches in the upper extent of a set of pipe supports disposed transversely of the pipe lengths at stations spaced along the lengths. Another method step is horizontally disposing further numbers of pipe lengths in further similarly notched pipe support sets at each station atop the supports therebelow to create an array of plural layers of plural lengths of pipe. A further step of the method is raising and lowering individual pipe lengths directly from and to receiving notches in the pipe supports.

A method for storing, handling and moving drill pipe in association with a well drilling rig having a drilling operations floor includes lifting a stand of drill pipe directly from an individual storage position in an array of stand storage positions. Another step is placing the lifted stand on a carriage adapted to support the stand at spaced locations along its length. The carriage is moved towards the floor to place one end of the carriage at the floor. Another step is elevating the one end of the placed stand above its placed positions on the carriage as the carriage nears the floor. The stand is hoisted via its one end to a vertical position above the floor while the other end of the stand is movably supported on the carriage.

DESCRIPTION OF THE DRAWINGS

The above-mentioned and other features and aspects of the structures and procedures provided by this invention are described more filly below with reference to the accompanying drawings in which:

in FIGS. 5 and 6, the bridge cranes are shown in positions different from FIG. 4;

FIG. 17 generally shows the mechanisms (somewhat different from those shown in FIGS. 1B, 7, 11, 11A and 12) for indexing the racker sleepers between their deployed and retracted (stowed) positions and for securing the crane lift columns and lift head assemblies into a stowed state;

DESCRIPTION OF THE ILLUSTRATED EMBODIMENTS OF THE INVENTION

Figure 1A:
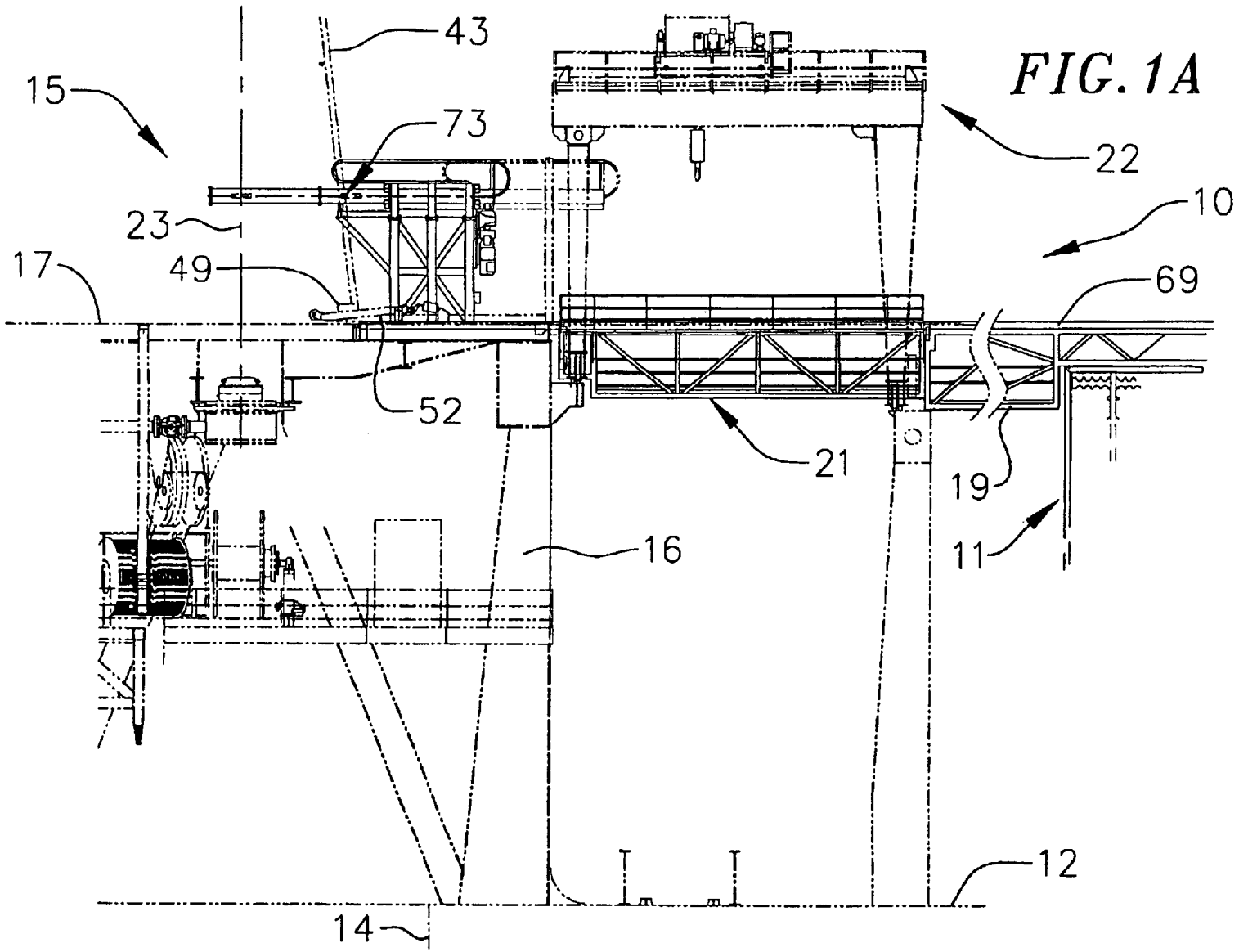
FIG. 1 is composed of FIGS. 1A and 1B which overlap and respectively are elevation views of the rear (drill floor) and forward (horizontal racker) aspects of an overall pipe storage and handling system according to this invention as preferably provided on the main deck of a drillship.

The following description and the accompanying drawings pertain to a presently preferred location of a preferred horizontal pipe racker in a drillship forward of a drill rig derrick in the drillship. Adjectives and other terms descriptive of horizontal directions (such as "forward," "aft," "port" and "starboard") are used with reference to that preferred location. It will be understood that the racker and its associated equipment could be located in other positions relative to the drill rig derrick in a different arrangement of drilling equipment, in which event other terms descriptive of horizontal directions would be apt and consistent with the scope and content of this invention.

In general terms, a pipe racker system includes a main foundation and support structure, multiple levels of indexable sleepers which define racks on which pipe is stored horizontally, a mechanism, such as a bridge crane, to transfer drill pipe stands between the sleepers and a drill pipe transporter, a drill pipe transporter to transport the pipe between the pipe racker and the drill floor, and a control system to provide the man-machine interface and to perform automatic control functions and to enable manual control operations to be performed. The drill pipe transporter preferably includes a carriage system which is comprised of a skate cart movable between the vicinity of the sleepers and the drill floor at the level of the floor, a further cart on the skate cart for receiving and supporting the pin end of a pipe stand being moved to or from the sleeper array. The drill pipe transporter also comprises low and high lift mechanisms for elevating and lowering the box end of a pipe stand from and to the skate cart at the drill floor, and a pipe stabber at the drill floor for guiding the lower end of a pipe stand between the carriage system and the vertical axis at the drill floor at which drilling operations are performed.

More particularly, the structural aspects of a pipe storage and handling system according to this invention includes a track which extends from one end adjacent the drilling rig to an opposite end remote from rig floor. The skate cart travels along the track and protectively supports a length of drill pipe disposed longitudinally with respect to the track. A pipe storage bin is disposed laterally of the track. The bin includes the horizontal pipe support sleepers which are cooperatively configured for individually supporting plural drill pipe lengths in an array of plural vertically spaced layers of pipe lengths with plural lengths in each layer. The array of sleepers is effective to support the pipe without subjecting any pipe length in the array to loads due to pipes and sleepers above or adjacent to it in the array. The storage bin also includes drive mechanisms connected to the pipe support sleepers. The drive mechanisms are selectively operable to move the individual sleepers between positions in which the sleepers are in the array and positions in which the sleepers are removed from the array when not supporting a drill pipe length.

The system also includes a pipe lifter. The pipe lifter is disposable above the sleeper array and is operable to move individual pipe lengths between the array and the carriage. More particularly, the pipe lifter can include several controllable magnetic pipe lifting heads which are spaced from each other along the length of the sleeper array. The several lifting heads are effective to lift and to hold a pipe length. The lifter preferably also includes indexable mechanical safety supports which are movable into and out of supportive relation to a pipe length which has been lifted by the lifting heads. The pipe lifter preferably includes a bridge crane above and movable between the skate cart track and the pipe storage bin. The crane includes mechanisms for raising and lowering the several lifting heads and the safety supports if present in association with the lifting heads.

The control subsystem preferably monitors the position of the lifting heads and permits effective demagnetization of the lifting heads only when the load of a pipe length held by the heads has been accepted by the carriage or by pipe support sleepers in the bin. The control subsystem can be defined to operate at desired times and in desired sequences in a semiautomatic manner.

Further, the system preferably includes a second pipe storage bin disposed on the other side of the skate cart track from the first bin. A second pipe lifter preferably is provided for the second bin. Where the system includes two pipe storage bins and two pipe lifters, the two pipe lifters preferably are arranged to service either bin providing redundancy of pipe lifters.

The pipe storage and handling system also has procedural aspects which are described or made apparent from the following descriptions of presently preferred and other embodiments of the system.

FIGS. 1A and 1B and FIGS. 2A and 2B, respectively, are side elevation and top plan views of a pipe storage and handling system 10 according to this invention. The system includes a horizontal pipe racker subsystem 11 which is supported on the main deck 12 of a deepwater drillship by a substructure 13; it is within the scope of this invention to locate racker 11 directly on deck 12 or upon such other foundation as may be appropriate to the nature and location of the operations supported by the racker and other associated structures described below. In the preferred arrangement depicted, the racker substructure has a height on the order of twenty feet (6.1 meters). Racker 11 is shown to be located in the drillship forward of a drilling rig 15 which is supported on the vessel main deck by its own substructure 16 which locates a floor 17 of a drilling platform a desired distance above the main deck. Drilling rig 15 is located over a vertical passage 14 through the drillship hull. The racker substructure serves, among other things, to elevate racker 11 above main deck 12 adequately that the path of fore-and-aft movement of a drill pipe skate cart assembly 18 is horizontal and is substantially at the same height as the drill floor above the main deck. The skate cart assembly provides a carriage which transports drill pipe stands in a fore-and-aft direction within system 10. A skate truss 19, which supports the skate cart in its movement, preferably along the vessel's longitudinal centerline, extends from the forward end of the racker to the drill floor. As shown in FIG. 1A, a portion 21 of the skate truss 19 just forward of the drill rig can be removable to enable a transversely movable bridge crane 22 to be used to move a blowout preventer, or other equipment as needed, into position on the vessel centerline before being moved rearward into alignment with a vertical well centerline 23, i.e., the drilling axis as defined in the drilling rig. The removable portion of the skate truss, when in its installed position shown in FIG. 1A, preferably is supported at its opposite ends on the elevated athwartships rails and rail supports 16 provided for crane 22.

As is characteristic in drillships, the drilling rig 15 is located at about amidships of the vessel hull over the vertical passage 14 (known as a "moonpool") through the hull. The rig includes a derrick (not shown) equipped with a crown block atop the derrick, a traveling block in the derrick, and a drawworks operable for raising and lowering the traveling block along well centerline 23 above the rig floor. The drawworks also can be operated to raise and lower other blocks or lifting hooks in the derrick, and to perform other functions as known in the oil and gas drilling industry.

Skate cart 18 and skate truss 19 are components of a pipe handling subsystem in the overall pipe storage and handling system 10.

Figure 5:
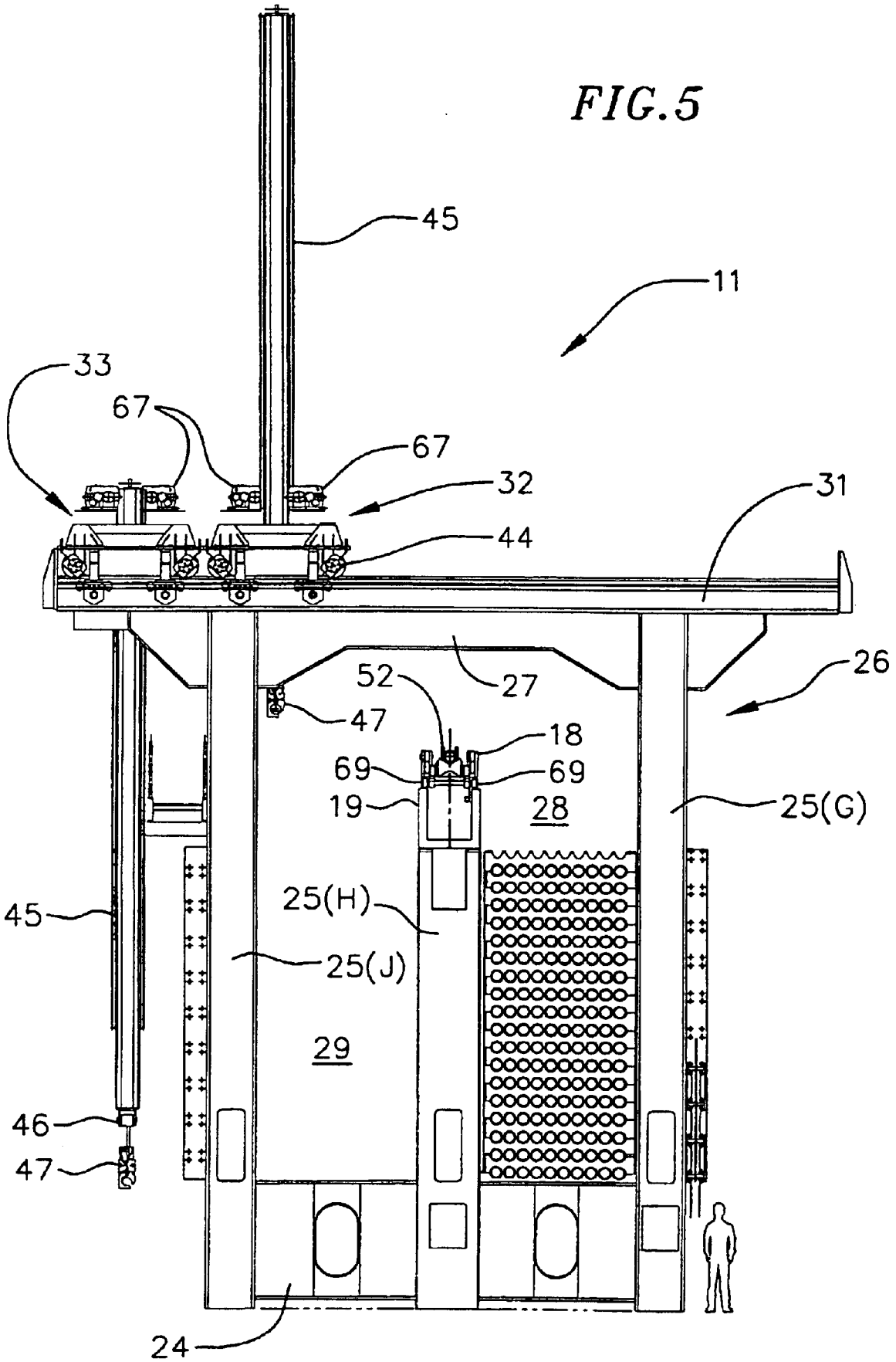
FIG. 5 is an elevation view of the forward end of the racker, the view taken aft of the forward buckboard.
Figure 6:
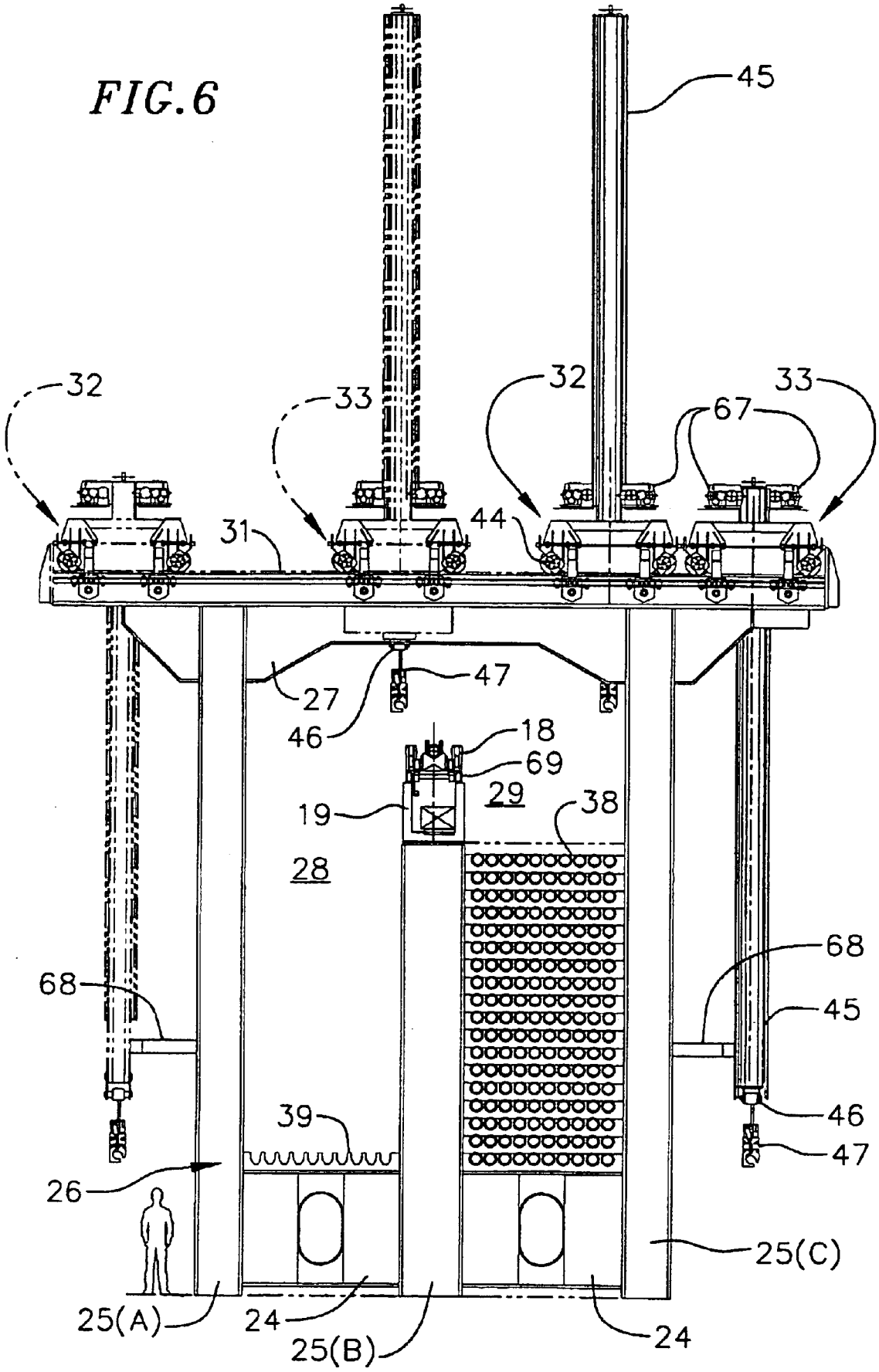
FIG. 6 is an elevation view of the rear end of the racker, the view taken forward of the aft buckboard.

As shown best in FIGS. 1B and 3–6, the structure of racker 11 includes an assembly 26 composed of a relatively massive base 24 and of columns 25. Assembly 26 preferably is constructed to be stiff and rigid in its own right. The substructure 13 which supports that assembly on the vessel main deck both supports and secures the assembly in place as a part of the ship structure and substantially isolates that assembly from bending deflections in the ship hull. There preferably are nine columns which are denominated generally as 25 in the drawings except in FIG. 3 which is a plan view of the column pattern in which the columns have positions A, B, C, D, E, F, G, H and J. Positions A, B and C, positions D, E, and F, and positions G, H and J are each arrayed along lines transverse to the vessel centerline respectively at the rear, center and forward positions of the racker. Those columns at positions A, D, and G are located on a line to port of and parallel to the centerline, those at positions B, E, and H are on the centerline, and those at positions C, F and J are on a line to starboard of and parallel to the centerline. The columns at the corner positions A, G, C and J are of the same height which is greater than the height of the centerline columns and the outboard center columns D and F. The upper ends of the outboard column pairs at the forward and aft portions of the racker are interconnected by transverse beams 27 which have outboard extensions from those columns, as shown in FIGS. 5 and 6. The space below the upper ends of the centerline columns and between those columns and the port outboard columns comprises a port pipe storage bay or bin 28. A starboard pipe storage bay or bin 29 is formed below the tops of the centerline columns and between those columns and the starboard outboard columns. The centerline columns support corresponding portions of skate truss 19. Columns 25 are interconnected at their bases by longitudinal and transverse girders which are components of base 24.

The upper ends of the transversely aligned outboard corner columns and their interconnecting beams 27 support transversely oriented forward and aft guide and support rails 31 for a pair of longitudinally extending port and starboard bridge cranes 32 and 33, respectively.

Figure 1B:
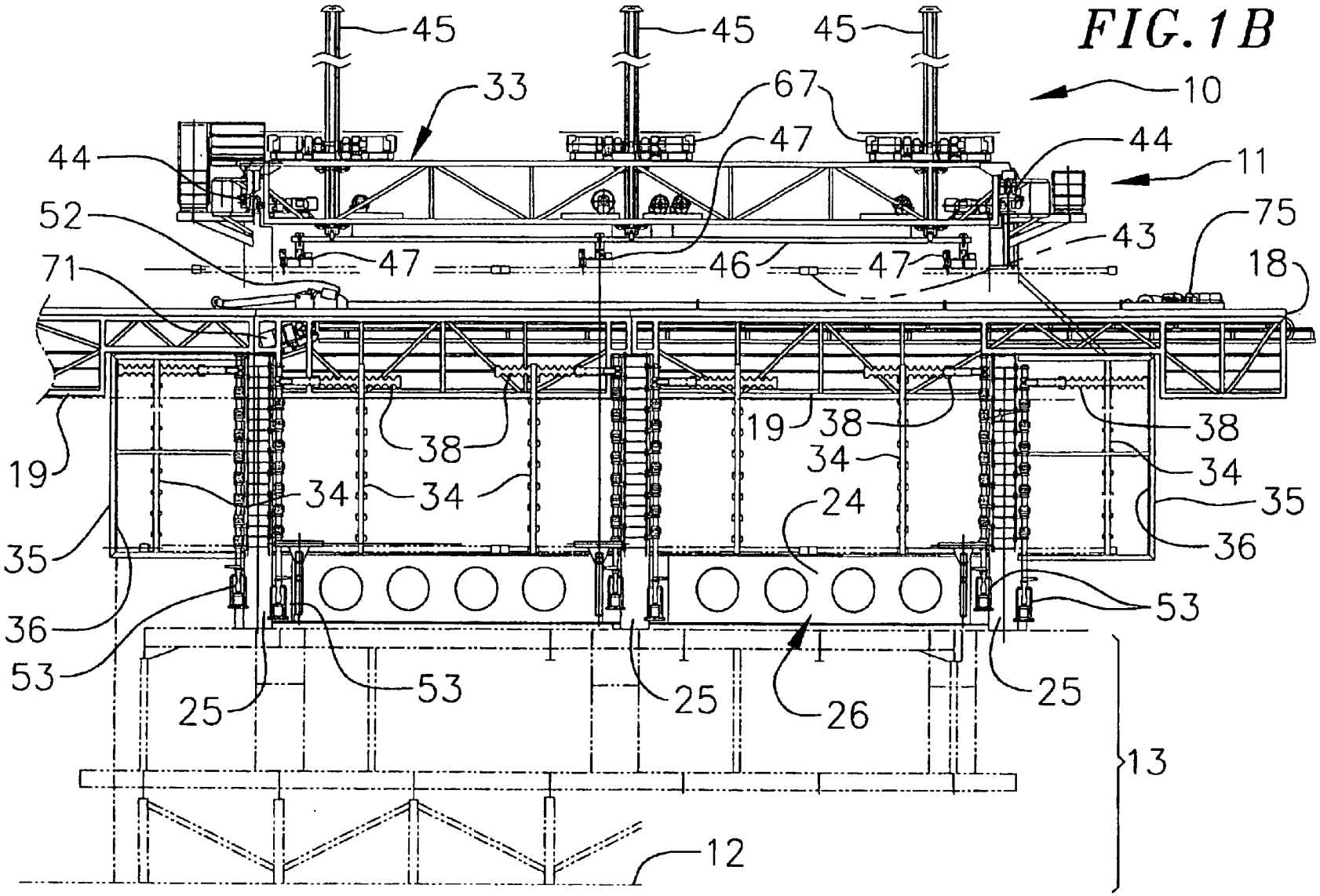

Additional vertical members are located in the racker along the outboard sides of storage bins 28 and 29, as at 34 in FIG. 1B. A transverse vertical plate 35, attached to structural members, is located at each of the ends of the bins and supports wooden buckboards 36 which face toward the respective bins. The buckboards limit fore and aft sliding motion of pipe stands which are individually supported in the racker without damaging the threaded connection features at the ends of the stands.

Figure 7:
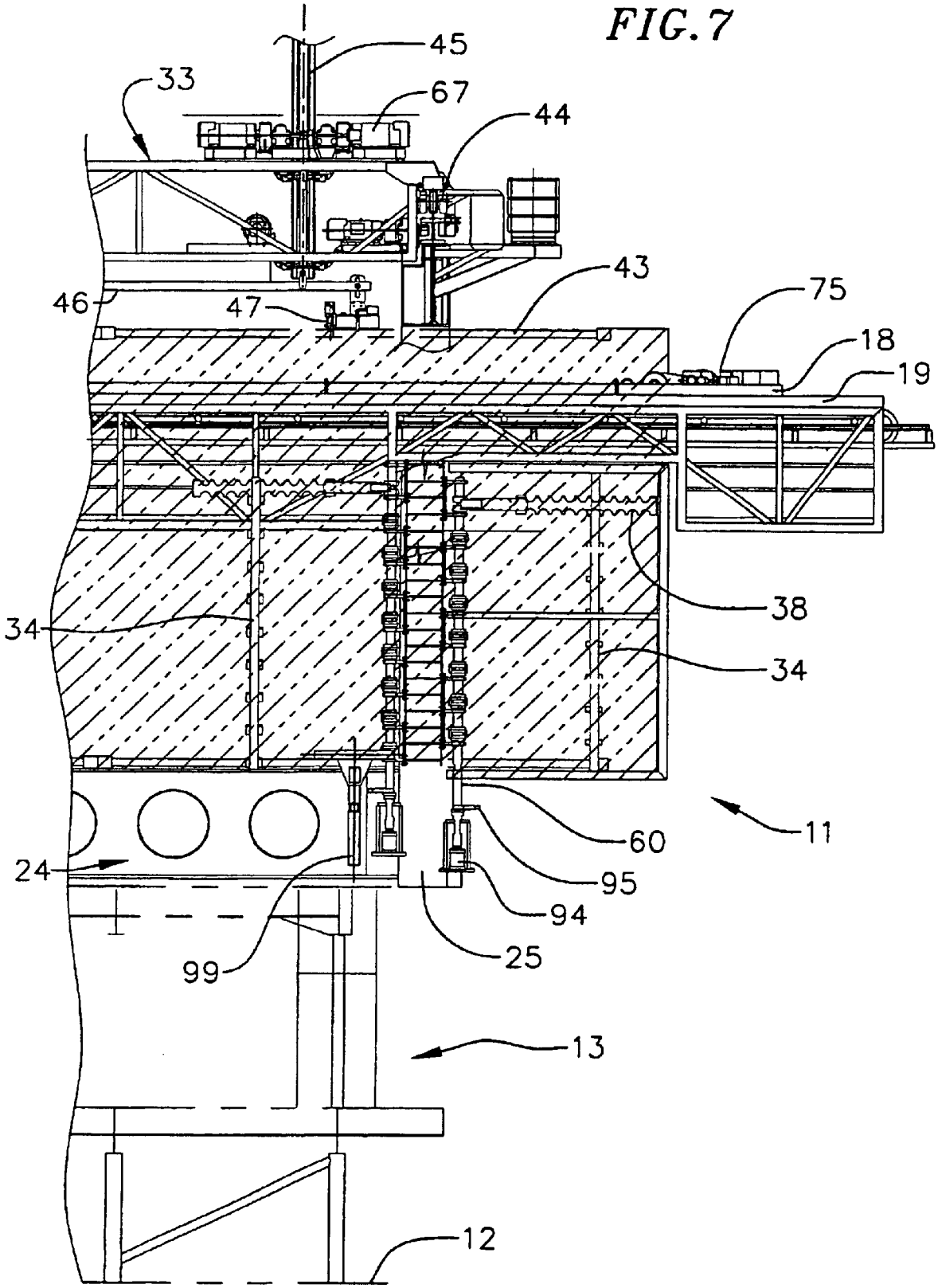
FIG. 7 is a fragmentary elevation view of the forward portion of the racker as supported on the main deck of a drillship and shows, among other things, walkways and ladders for access of personnel to different portions of the racker.

The cross-hatched area in FIG. 7 represents the vertical and forward limits of the volume in the racker in which a triple stand of drill pipe can be found either when stored in the racker or when being moved in a horizontal attitude within, to or from the racker.

Figure 13:
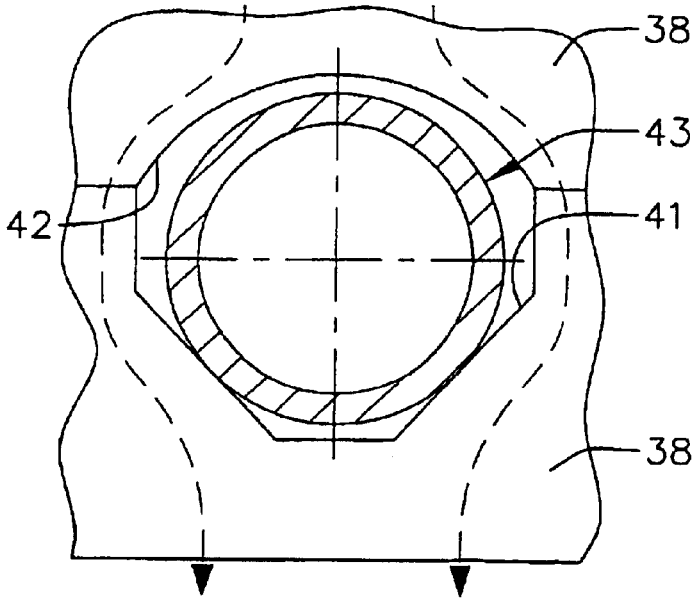
FIG. 13 is a simplified fragmentary elevation view of a drill pipe stand (shown in transverse cross-section) as supported between two vertically adjacent sleepers.

As noted above, the racker structure includes means for individually supporting each triple stand of drill pipe which is to be stored at any time in the racker. Those means include a plurality of horizontal sleepers 38 and 39 which cooperate with each other and with the stands in the manner shown in FIG. 13. Sleepers 38 are movable, whereas bottom sleepers 39 are fixed and are carried by the transverse portions of the racker base 24 as shown in FIG. 6. The movable sleepers are sufficiently long that, when in their deployed positions, they extend across the entire width of the respective pipe storage bin between transversely aligned ones of columns 25. The pipe stands are stored in an array of layers in each of bins 28 and 29, there being plural stands in each layer. Except for the stands in the topmost layer, each stand is disposed between two vertically adjacent sleepers. The vertically adjacent sleepers are configured to keep adjacent stands in a layer in spaced relation to each other, and to carry the vertical loads of sleepers and of stands supported by the sleepers to the racker base 24 within the sleepers themselves and not through any stands in the storage array. The arrows in FIG. 13 represent the way in which vertical forces are carried in the deployed sleepers around the pipe stands received in the sleepers. Thus, the only forces applied to a stand when stored in the racker are the forces attributable to that stand itself due to its own weight and due to motions of the drillship. A given stand, when stored in the racker, does not have applied to it any portion of such forces associated with any other stand. In the preferred racker shown in the drawings, sleepers 38 and 39 are provided at each of three stations spaced along the length of each pipe storage bin.

The fixed sleepers 39 are notched at intervals along their top surfaces. The movable sleepers 38 are similarly notched at the same intervals along the top and bottom surfaces. The upwardly opening 41 notches have sloping sides; the downwardly opening notches 42 can be accurately shaped. The cooperating notches in vertically adjacent sleepers are sized so that a pipe stand 43 disposed in the space formed by a notch 41 and a notch 42 contacts only the upwardly opening notch 41. Therefore, the stand is not subjected to any forces attributable to sleepers or stands above it in the bin in which the stand is stored. If desired, the sloped surface of upwardly opening notches 41 can be defined by wood or by pieces of other materials which are softer than the metal of a pipe stand and which preferably cannot participate in electrolytic corrosion processes with the pipe. Each cooperating pair of notches 41, 42 has sufficient open area that the sleeper array can accept pipe of either a specified diameter or with a defined range of diameters with variations from truly straight to in excess of 0.2 percent of pipe length deviation from truly straight.

Figure 14:
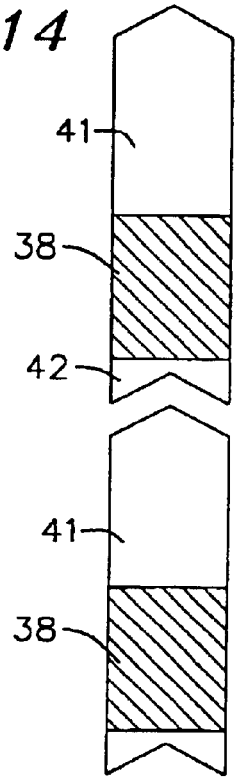
FIG. 14 is a simplified transverse cross-sectional elevation view of two vertically adjacent sleepers and shows the manner in which the sleepers can be keyed together in their deployed positions.

The stacked sleepers are mechanically keyed and interlocked between adjoining sleepers to prevent one sleeper from deflecting sideways relative to the long dimension of the sleeper; see FIG. 14. This assures the sleeper stack will remain aligned one sleeper above the other and that the drill pipe loads will follow a path down through the stacked sleepers to the base crossbeam supporting it. The notches 41, 42 in the sleepers preferably are configured to allow the notches to accommodate drill pipe ranging in diameter from five (5) inches to six and five-eighths (6⅝) inches; alternatively, the sleepers can be notched to accommodate a given size of pipe, thereby maximizing the number of stands disposable in a layer of the storage array, and the sleepers can be disconnectable from their indexing drive mechanisms and supporting bases to enable one sleeper to be exchanged for another of different capacity. The sleepers cooperate with pipe stands at locations along the stands between the pin and box features at the opposite ends of each of the individual pipe lengths forming the stands.

Resting the drill pipe between the sloped sides of a notch 41 increases the contact force between the sleeper and the drill pipe. The sliding friction between the pipe and the sleeper is proportional to the contact force and, thus, the sliding friction between the sleeper and the drill pipe is increased. The increased friction keeps the pipe from sliding along its length when it is subjected to dynamic loads along its length due to ship motions. When the drill pipe is subjected to dynamic loads in the direction of the sleeper length, the pipe is wedged into the sloped sides of the sleeper notch and will not roll in the sleeper.

The sleepers are mounted to be indexed to lift them off the sleeper below and to rotate them out of the pipe bin to expose the next layer of drill pipe stands. Conversely, when a sleeper becomes filled with a drill pipe stand in each notch 41, the next sleeper above is rotated to a position over the stack of sleepers below and then lowered until it rests on the topmost sleeper below. That mechanically locks the two sleepers together and contains the layer of drill pipe below the sleeper between the sleeper supporting the pipe and the one placed over it.

Drill pipe stands are moved between the sleepers in the pipe bins and the pipe transporter (i.e., skate cart 18) by means of a special bridge crane illustrated in FIGS. 1B, 2B, 4, 5 and 6. Preferably, there are two bridge cranes 32 and 33; while a single bridge crane could be provided to service both pipe storage bays, a pair of bridge cranes is preferred for efficiency and for redundancy if needed. Each bridge crane spans the distance between the two crane rails 31 at the ends of the pipe racker. Self-propelled trucks 44 at the ends of the bridge crane run on the rails 31 and drive the crane from one side of the pipe racker to the other. The rails 31 preferably are channel-like in cross-section, and the crane truck wheels preferably run in the channels so that the trucks are captive to the rails; see FIG. 6, e.g. The trucks of each bridge crane are synchronized to make them move together in unison. A set of two or more (preferably three) vertical lift members (columns) 45 are mounted in the crane bridge and are constrained to move only up and down relative to the bridge. The lift columns in each bridge crane are synchronized to move together and are connected at the lower ends by a long beam identified as a strongback 46, also called a spreader bar. The strongback is a carrier for permanent magnet lift heads 47 which function to attach to a stand of pipe and to release it when the magnetic field is broken.

The magnetic lift heads which make contact with the drill pipe are in the form of two long permanent magnet bars and preferably are arranged in a manner that they form an upside down trough. While the trough can be "V" shaped (see FIG. 23), it is preferred that the trough be semicircular, most preferably with a radius which fits the pipe being handled. The trough lays parallel to the direction of the drill pipe. The magnets preferably are attached to the strongback in a way that the they can rotate and translate in small amounts to allow the them to align themselves with the drill pipe being picked up. Aligning the magnetic heads with the drill pipe greatly increases the contact area between the pipe wall and the magnetic heads and hence maximizes the holding capacity of each magnetic pipe lifter. The pipe stand lift heads are described more fully below with particular reference to FIGS. 21–23.

When moving drill pipe from the pipe bins to the drill pipe transporter, a chosen one of bridge cranes 32, 33 moves sideways on its bridge trucks from a transfer position over the transporter to a discrete position over the drill pipe stand to be transferred; while both cranes can be operated concurrently, it presently is preferred to operate only one crane at a given time. The strongback is lowered by the vertical lift members 45 until the magnetic lift heads 47 are in contact with the drill pipe. The magnetic fields generated by the lift heads are effective to attach the lift heads to the drill pipe. The lift members are then raised to their highest positions in the bridge crane with the drill pipe coupled to the strongback by the magnets. The bridge crane moves from its position over the pipe bin to a position directly over the drill pipe transporter which is located along the center of the racker below the transfer position of the crane. The strongback is lowered until the drill pipe rests on the transporter skate cart, with the pin end of the pipe stand engaged in the pin cart; only then the magnetic fields are killed to release the drill pipe. After the magnets release the drill pipe, the bridge crane raises the strongback to its full upper position and then moves to pick up the next stand of drill pipe from a pipe storage bin.

Moving drill pipe from the drill pipe transporter to a pipe bin is the reverse of moving the pipe from the pipe bin to the transporter. The bridge crane picks up the drill pipe from the drill pipe transporter at the transfer position of the transporter carriage. The crane moves it to a specified open slot (position) in a pipe bin sleeper set. The pipe stand is released from the lifting heads after the weight of the stand has been accepted by the pipe support sleepers. When a bridge crane is operating semi-automatically, the bridge crane will always stop at its transfer position above the transporter. The pipe is lowered to and released on the transporter only by direct manual command from a control console. Similarly, when the strongback is waiting over the transporter to pick up a drill pipe, it will commence lowering and attaching to the drill pipe only when it is commanded to do so from the control console. This feature helps avoid several hazards that otherwise would have to have sophisticated interlocks to prevent. The drill pipe will not be lowered and released when the transporter is not in position to receive it. The drill pipe will not be lowered or released while the transporter is still moving. Adherence to those rules simplifies the racker system controls and timing since the bridge crane always starts a cycle from a "hold" at its transfer position and ends the cycle at the same position. It does not have to be timed to meet the drill pipe transporter.

The drill pipe transporter, (see FIGS. 8, 9 and 10) moves the drill pipe between the horizontal pipe racker where the drill pipe is stored and the drill floor where the pipe is used. The transporter pipe carriage arrangement preferably is comprised of the long skate cart 18, a second cart-like device identified as a pin cart 49, and drive systems (not shown in FIGS. 8, 9, and 10) to move the skate and pin carts. The pin cart is carried by and is driven along the skate cart.

The skate cart preferably is about 88 feet (26.8 m) long and the drill pipe stand being transported will range from about 91 feet (27.7 m) long to about 95.5 feet (29.1 m) long. The drill pipe stand being transported on the skate cart will extend at its rear or box end beyond the rear end of the skate cart from three feet (0.9 m) to eight feet (2.4 m). The remaining length of the drill pipe will be cradled on the skate cart, and the forward pin end of the pipe stand will be carried in pin cart 49. The skate cart rides on wheels that run captively in channels affixed to the skate truss. The channels are installed on the skate truss 19 and run from the end of the pipe racker farthest from the drill floor to the drill floor.

The pin cart rides on wheels which captively engage tracks mounted on the skate cart, thus allowing the pin cart to move relative to the skate cart. When drill pipe is loaded on the skate cart, the pin (forward) end of the pipe rests in the pin cart while the box (rear) end of the drill pipe extends over the other end of the skate cart. When the skate cart approaches the drill floor, the box end of the drill pipe is raised by a low-lift pipe lifter 52 and is held about four to five feet above the drill floor. An elevator, typically carried by the traveling block in the drill rig derrick, is attached to the box end of the drill pipe so held above the drill floor, and the box end of the drill pipe is lifted up above the drill floor by the drawworks and traveling block. As the box end of the pipe is lifted, the skate cart will continue to travel toward the drill floor until it reaches its rearward limit. Then the pin cart holding and supporting the pin end of the drill pipe will move along the skate cart toward the drill floor with the pin end of the pipe as the pipe is raised and rotated from a horizontal to a vertical position in the derrick. When the drill pipe becomes nearly vertical, it is lifted off the pin cart and installed in the working drill string; before the drill pipe is lifted off the pin cart and until it has been made part of the working drill string, it is held in the head 72 of pipe stabber 73. The pin cart is moved back to the other end of the skate cart, preferably as the skate cart is returned to its position forward in the pipe racker.

Figures 11, 11A:
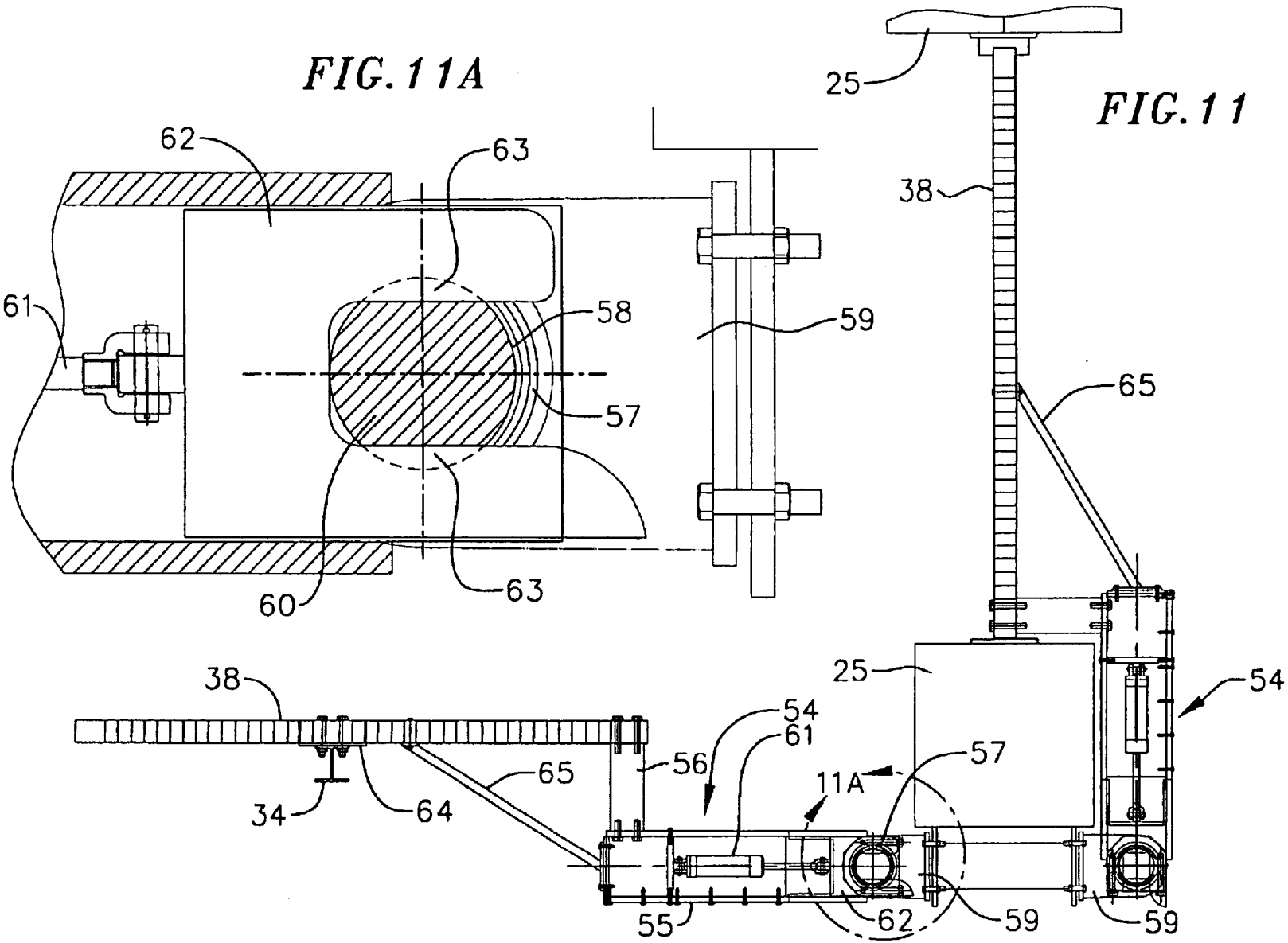
FIG. 11 is a fragmentary top plan view which shows the pipe support sleeper and sleeper drive mechanisms associated with an outboard stanchion of the pipe racker, one sleeper being shown in a deployed position and the other being shown in a retracted position.
FIG. 11A is a simplified enlargement of a portion of FIG. 11.

FIGS. 5 and 6 show in elevation views the port and starboard pipe storage bins. In each of those FIGS., one bin is shown full and the other is shown empty with all movable sleepers 38 removed from the bin volume. As shown in FIG. 11, each sleeper 38 has a deployed position in which it extends from its supporting outboard column 25 to the adjacent centerline column. Each sleeper also has a retracted position which is disposed at a 90° relation to its deployed position and in which the sleeper is outside the outboard side of the bin as defined by the inboard faces of the outboard columns; see, e.g., FIGS. 1B, 4, 7, 11, 12, 17 and 18.

Figure 12:
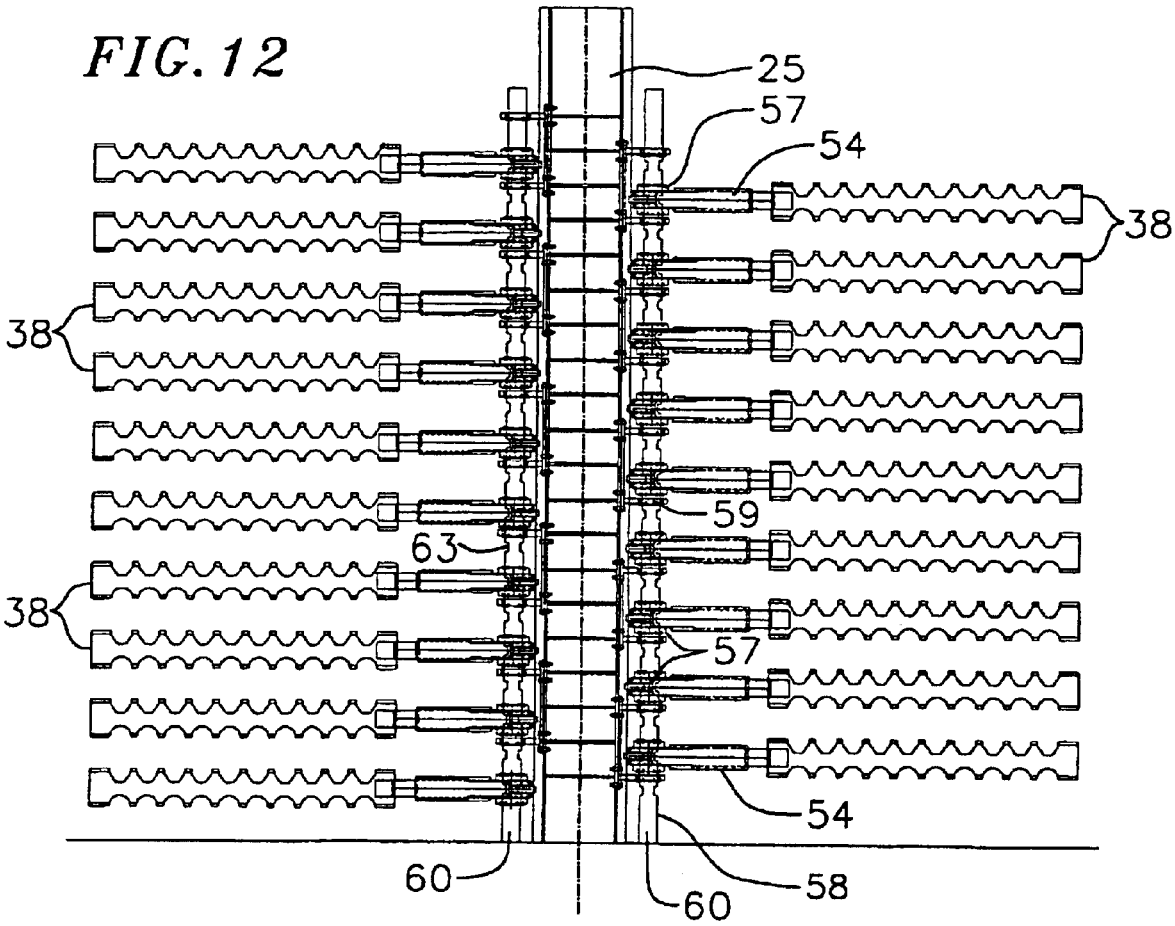
FIG. 12 is a fragmentary elevation view showing all of the sleepers associated with an outboard pipe racker stanchion with the sleepers indexed to their retracted positions.

As shown in FIG. 5, e.g., there can be 18 movable sleepers 38 in each bin in association with each outboard racker column 25; fewer or more sleepers can be provided, as desired. That set of 18 sleepers is composed of a group of 9 even numbered sleepers and a group of 9 odd numbered sleepers. For purposes of example, the odd numbered sleepers in the set (counting upwardly) are associated with the aft face of the adjacent outboard column, while the even numbered sleepers in that set are associated with the forward face of that same column. (It will be noted that FIG. 12 shows 19 movable sleepers associated with a racker column.)

As shown in FIG. 11, each sleeper 38 is connected to a base 54 which preferably is L-shaped in plan view. Each base has a major leg defined by an elongate frame 55 which is parallel to the related sleeper. Each base also has an arm 56 which extends laterally from one end of the frame and to which one end of the sleeper is connected. The end of frame 55 opposite from arm 56 defines a vertically oriented sleeve-like hub 57 which encircles two vertical bearing tubes 58 in one form of sleeper mounting and indexing arrangement of this invention; see FIG. 11A. The bearing tubes 58 are vertically in line with each other, one being at the bottom of the hub 57, the other at the top of the hub 57. The two bearing tubes 58 are separated by a distance of about 3 inches. The separation between the bearing tubes 58 provides an opening through which a fork 62 can move to engage with or disengage from a vertical, notched shaft 60 in FIG. 11A. Adjacent each of those openings between the bearing tubes 58 in each sleeper hub, shaft 60 is notched in parallel diametrically opposed locations; the notches form aligned horizontal keyways in the shaft, as at 63 in FIG. 11A. The vertical shaft 60 preferably is of sufficiently long extent that it is common to all the sleepers in a group; there are two shafts 60 associated with each outboard column 25, one for each sleeper group at that column. Each shaft 60 is axially and angularly movably mounted to the column 25 via support brackets 59 spaced along the vertical length of the shaft 60 between vertically adjacent sleepers. Each bracket 59 is comprised of a structure attached to the column on one end and attached to a vertically oriented sleeve-like hub and a tube bearing similar to the sleeper hub 57. The vertical shaft 60 is free to move vertically and to rotate in all the support brackets 59, and in the sleeper hubs 57 except when a selected fork 62 is engaged in a corresponding pair of aligned notches on the shaft. In that case, the sleeper associated with the engaged fork will move angularly and vertically with the shaft 60. Axial and angular motions of each shaft are produced by suitable drive mechanisms 53 (see FIG. 1B) which can be located along side the racker base 24 and to which the lower end of the shaft extends.

As shown in FIGS. 11 and 11A, each sleeper base frame preferably carries a double acting ram 61, preferably a pneumatic ram, which is coupled adjacent the base hub to a horizontally slidable fork 62 which opens toward shaft 60. The fork is movable horizontally through the opening between the bearing tubes 58 in the adjacent hub 57 into engagement of its two legs in the keyway notches 63 in the shaft. Engagement of a fork with the shaft connects the corresponding sleeper and its base to the shaft so that the sleeper can be moved vertically and angularly by axial and angular motion of the shaft. Each fork can be fully disengaged from the shaft 60.

Reference is made to sleeper 38 of FIG. 11 which lies in the bottom left portion of FIG. 11. That sleeper is in its retracted position and is supported about midway along its length in a holder and support bracket 64 carried by a racker side member 34. That sleeper is to be moved to its deployed position in the adjacent pipe storage bin; the other sleeper depicted in FIG. 11 is shown in its deployed position. Movement of a sleeper from its retracted position to its deployed position is achieved by the following operations:

1. ram 61 is operated to move fork 62 into engagement with the keyway notches 63 in shaft 60;
2. shaft 60 is raised to lift the sleeper out of engagement with its holder 64;
3. shaft 60 is rotated 90° in a chosen direction, thereby swinging the sleeper about its hinge axis at the shaft from its raised and retracted position to a raised and deployed position;
4. shaft 60 is lowered to cause the sleeper to register with the deployed sleeper below it and to cause the chevron or tongue-and-groove contours on the abutting sleeper faces (see FIG. 14) to engage;
5. ram 61 is operated to disengage the sleeper's fork from shaft 60; and
6. shaft 60 is rotated 90° in a direction opposite to the chosen direction to return to its starting angular position where it is ready to be engaged later by the fork of the next highest sleeper along that shaft.

Obviously, movement of a deployed sleeper to its retracted position involves essentially the reverse of the operational sequence described above.

The control arrangement for system 10 preferably includes sensors and interlocks which monitor the retracted/deployed status of each sleeper in each pipe storage array, and which assure that only the proper sleepers are engaged with and moved by shafts 60 at any time during loading or unloading of drill pipe into or from each pipe storage bins. If, for some reason, one or more sleepers in a set fails to deploy or to retract when commanded, the operator is alerted and a signal is provided to the control system to prevent the crane in service from lowering pipe until the sleeper positioning issue has been addressed. It is preferred to index the set of sleepers for a given layer of a bin in unison.

FIG. 11 shows the benefit of mounting each movable sleeper 38 to an L-shaped base 54. That geometry of the sleeper base enables the hinge structures, about which the bases swing as the sleepers move between their deployed and retracted positions, to be located adjacent to the outboard corners of the outboard columns 25 of the racker. When the sleepers are retracted, they are located outside the adjacent pipe storage bin. When they are deployed, the L-shaped sleeper bases wrap around the adjacent column so that the sleepers extend transversely across the bin and span the space between the corresponding outboard column and the related center column.

FIG. 11 also shows that a brace 65 can be connected from the unhinged end of each sleeper base frame to a point on the sleeper which is near its midlength. Braces 65 can lie in planes between the upper and lower surfaces of the sleepers and so will not interfere with the drill pipe lengths racked on the deployed sleepers.

FIGS. 5 and 12, e.g., show how the odd and even numbered sleepers in each sleeper set interdigitate in their deployed positions.

Each bridge crane lift column 45 preferably is driven vertically, in one method, by a pair of drive motors 67 (see FIG. 4, e.g.) which drive pinions meshed with a respective one of a pair of racks which are carried along opposite sides of the lift columns. Alternately, the lift columns maybe raised and lowered by a single shaft having three pinions to engage the corresponding racks on the three lift columns.

As noted above, it is desirable that the control subsystem of system 10 receives information about the current position of each bridge crane 32, 33 and about the vertical position of the pipe lifting heads 47 carried by each bridge crane. It is also important that all lift columns on a bridge crane be operated in close synchronism, and that the self-propelled trucks 44 at the opposite ends of each bridge crane be operated in close synchronism. Synchronizing and position informative signals preferably are generated by each lift column drive mechanism and by each bridge crane truck as they are operated. Those signals can be generated in similar ways. For example, as a bridge crane traverses racker 11 on its support rails 31, it can operate switches which are spaced along each track. Also, as each crane truck moves, rotation of one of its drive shafts can operate an encoder. The encoder output signals generated by the trucks at the opposite ends of the crane can be compared and the result used to synchronize the operation of the trucks. Operation of the switches along the crane rails can be used to periodically reset the encoders. The combination of switch signals and encoder signals can provide high precision information about the location traversely of the racker of the pipe lifter heads carried by the crane. Similar switches and encoders can be used in the lift column drives to synchronize the motions of the several columns in each crane and to provide high-precision information about the vertical position of the crane's pipe lifter heads.

Switches operated by the sleepers can indicate whether a sleeper is deployed or retracted. Combining the disposition of the sleepers and their known height with the vertical position of the lift columns is sufficient information to accurately position the vertical lift columns and the magnetic heads to pick up or set down pipe in the sleepers. Also, it is preferred that the sleepers have associated with them sensors which are effective to detect the presence of personnel on the sleepers or on the top pipe stands supported by the sleepers.

FIG. 6 shows that the bridge cranes 32, 33 can have stowed positions outboard of the pipe storage bins on the positions of rails 31 which extend laterally away from the pipe storage bins. When the cranes are stowed, the lift columns for the cranes can be lowered to essentially fully depend from the crane truss (bridge) structures and trucks. In that condition, the crane lift columns and the structures carried by the lower ends of those columns can be secured from pendulous motion by being connected to keeper brackets 68 which preferably extend outwardly from the racker sides. This storage ability for the bridge cranes and their lift columns is especially useful in the context of use of racker 10 on a floating vessel. Weather or sea state conditions may make it prudent and desirable to discontinue drilling operations for a time. During that time, the cranes are stowed as described and their lift columns are secured from pendulous motions which otherwise could result in damage to them or to other components of the racker.

Figures 8, 9, 10:
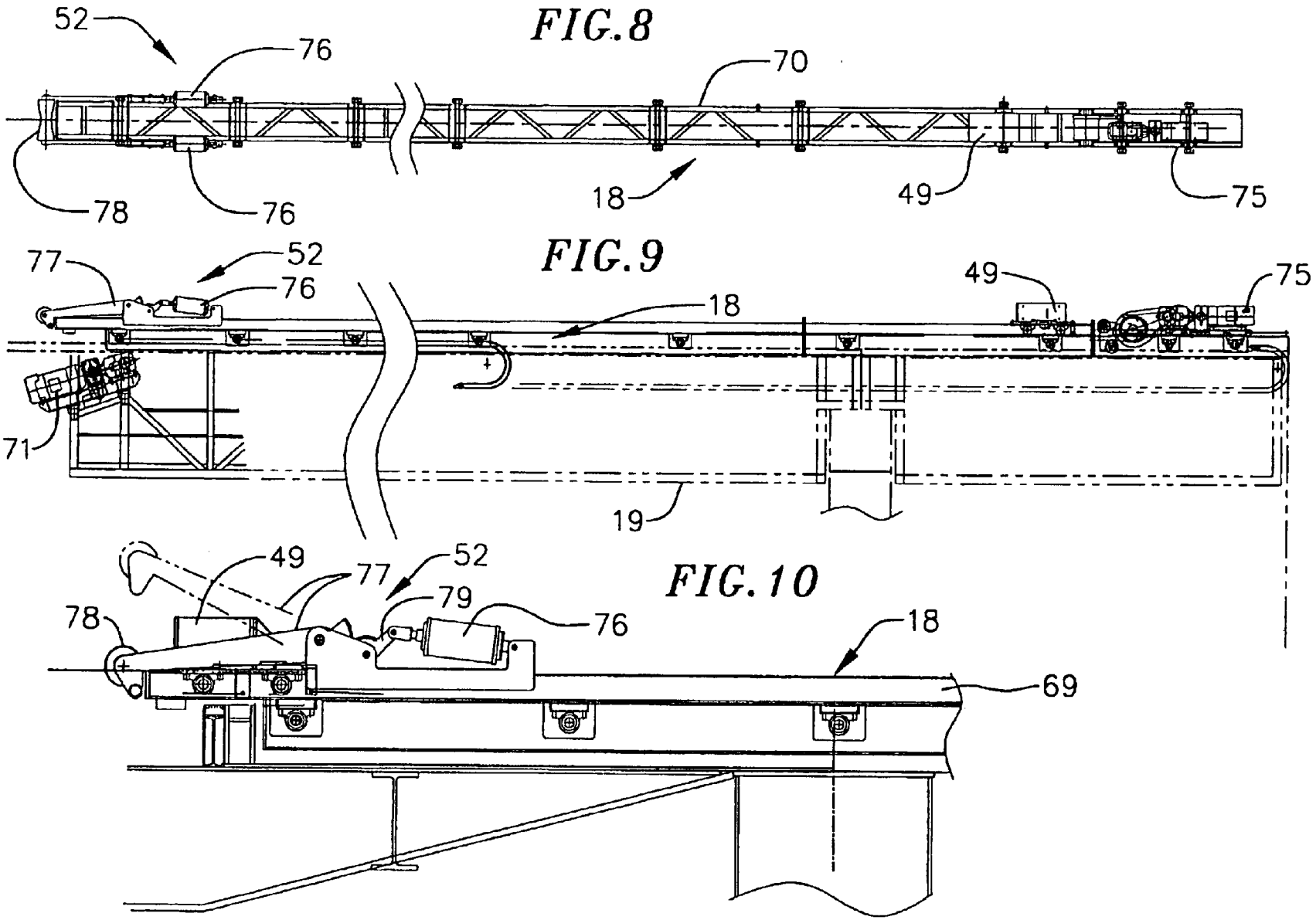
FIG. 8 is a fragmentary top plan view of the pin cart and skate assembly which is a component of the pipe handling aspect of the system shown in FIGS. 1 and 2.
FIG. 9 is a fragmentary elevation view of the pin cart and skate assembly shown in FIG. 8.
FIG. 10 is an enlarged fragmentary elevation view which shows the low lift aspects of the pin cart and skate assembly in the condition in which the pin cart is at its limit of travel along the skate assembly adjacent to the drilling floor.

FIGS. 8 and 9 respectively are top plan and side elevation views of skate cart 18. The skate cart has an elongate horizontal, rather narrow truss-like frame 70 shown in FIG. 8. At spaced locations along its sides, frame 70 is supported by wheels which run captively in tracks which extend along the top of the skate truss 19. The skate cart is drivable back and forth along the skate truss by a drive motor 71, preferably located under the cart rails near the rear end of racker 11 at a location which is under the cart when the cart is either at its forward limit of travel or at its rearward limit of travel. The motor preferably is an electric motor which rotates a pinion which meshes with a rack carried by frame 70. The skate cart drive preferably includes a brake which is operable to stop the cart and to hold it at any position with in its range of travel. Also, it is preferred that horizontally disposed shock absorbers are carried by fixed structures at the opposite limits of skate cart motion to cooperate with the skate cart as it moves back and forth during operation of system 10.

The forward limit of travel of the skate cart is shown in FIG. 1B. The rearward limit of travel of the skate cart is within the perimeter of drilling rig floor 17 toward well centerline 23 from the forward edge of the rig floor and from a horizontal pipe stop 130 shown in FIG. 17. As is known in the oil and gas drilling industry, the pipe stop is a horizontal bar which is located about four to five feet or so above the rig floor adjacent the forward limit of travel of a horizontally reciprocable pipe handling head 72 of a pipe stabber 73; see FIGS. 1A and 2A. The pipe stop limits the rearward motion of the pin end of a pipe stand 43 which has its box end engaged in a pipe elevator and raised in the rig derrick above the rig floor in the course of moving the pipe stand from racker 11 into connection with the upper end of a pipe string supported along the well centerline substantially at or above the rig floor. The pipe stop comes into effect when the pin cart 49 on the skate cart also is at its rearward limit of movement along the skate cart. The pipe stop holds the lower end of the essentially vertical pipe stand in a position for engagement of the stand, adjacent its lower end, by the gripper mechanism which is part of the pipe stabber head 72. When the stand has been engaged by the pipe stabber, the stand is raised so that the pin end clears the pipe stop. The stabber then is operated to move the lower end of the pendulously supported pipe stand along a fixed path into alignment with the well centerline where it can be connected to the upper end of the pipe string.

Figure 2A:
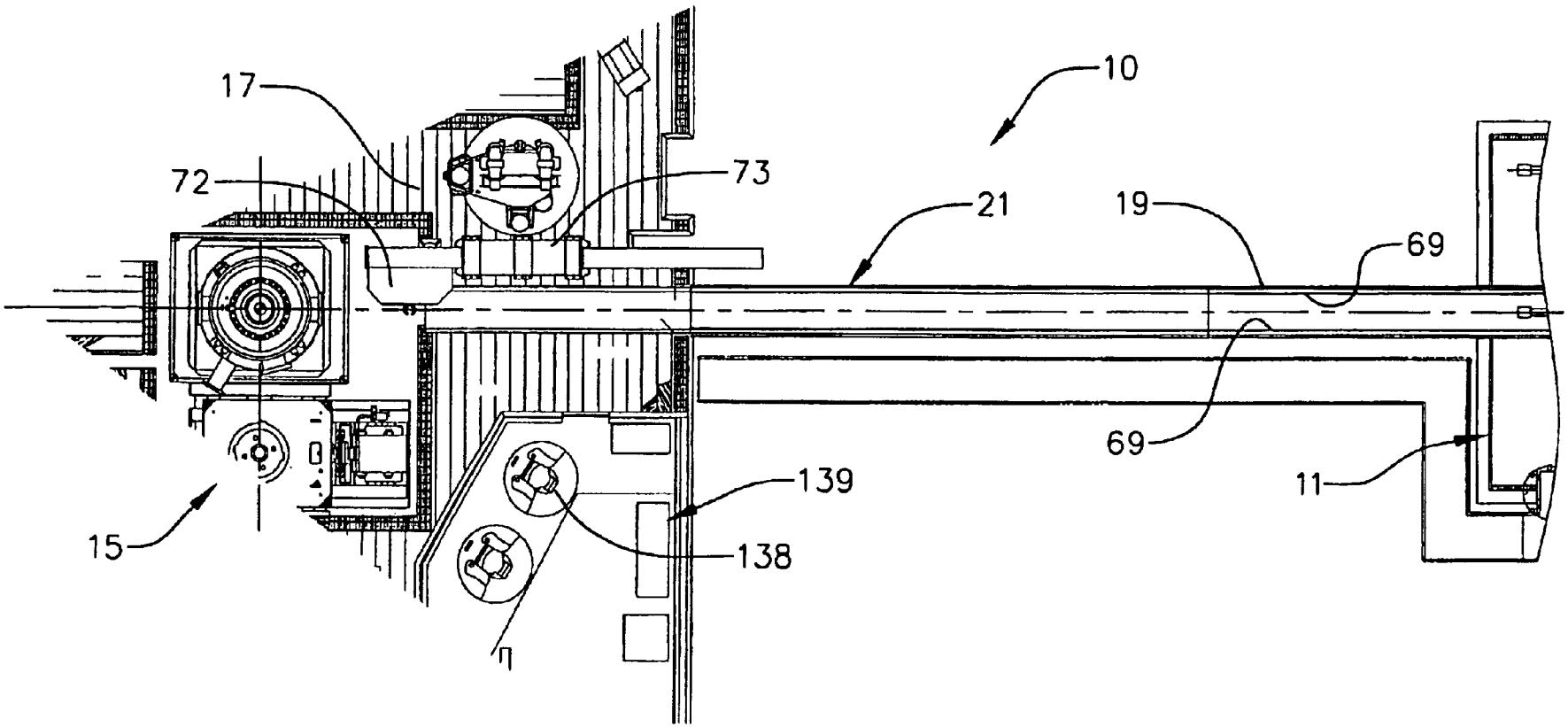
FIG. 2 is composed of FIGS. 2A and 2B which overlap and respectively are top plan views of the rear (drill floor) and forward (horizontal racker) aspects of the system shown in FIGS. 1A and 1B.
Figure 2B:
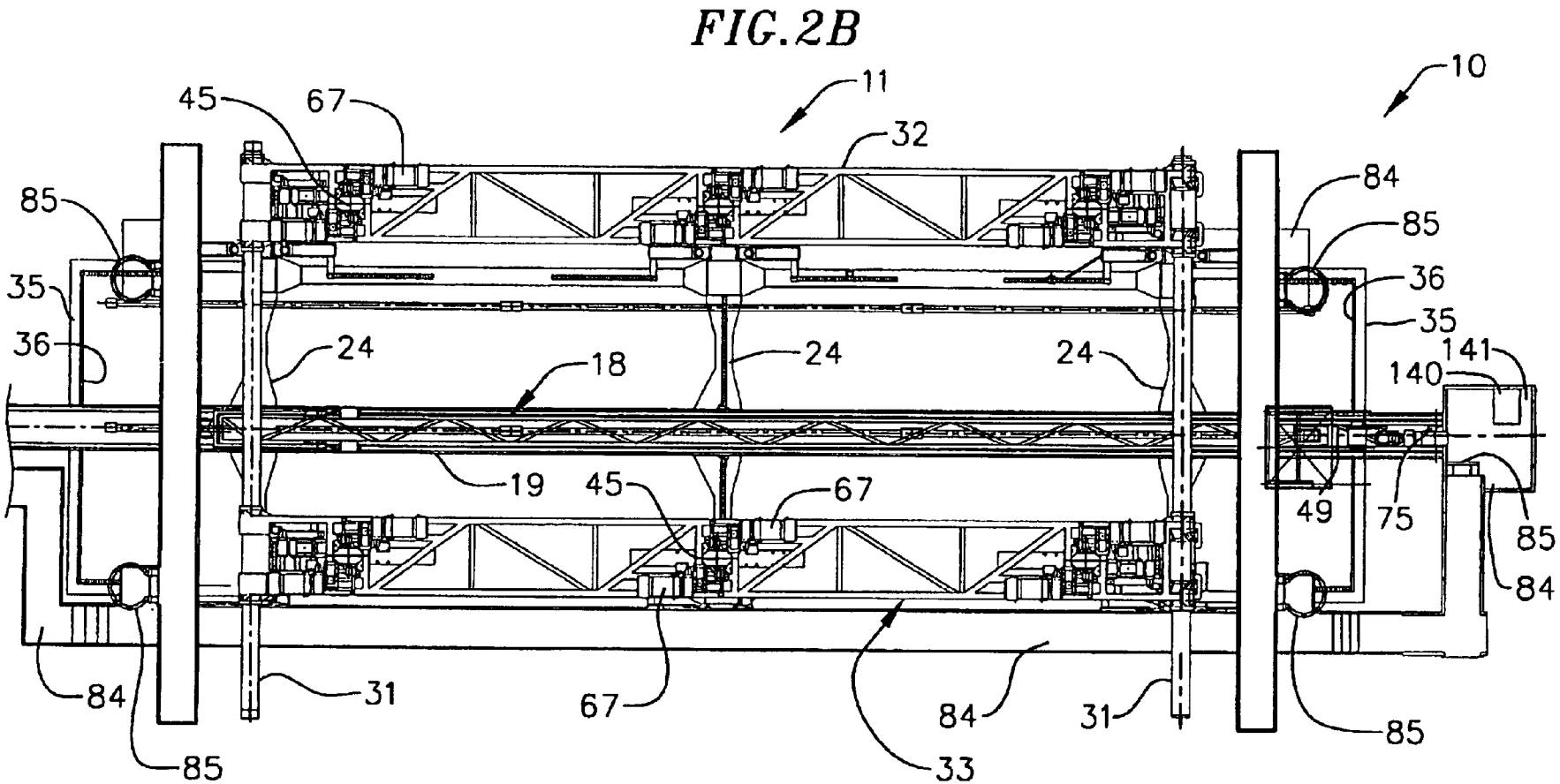
Figure 3:
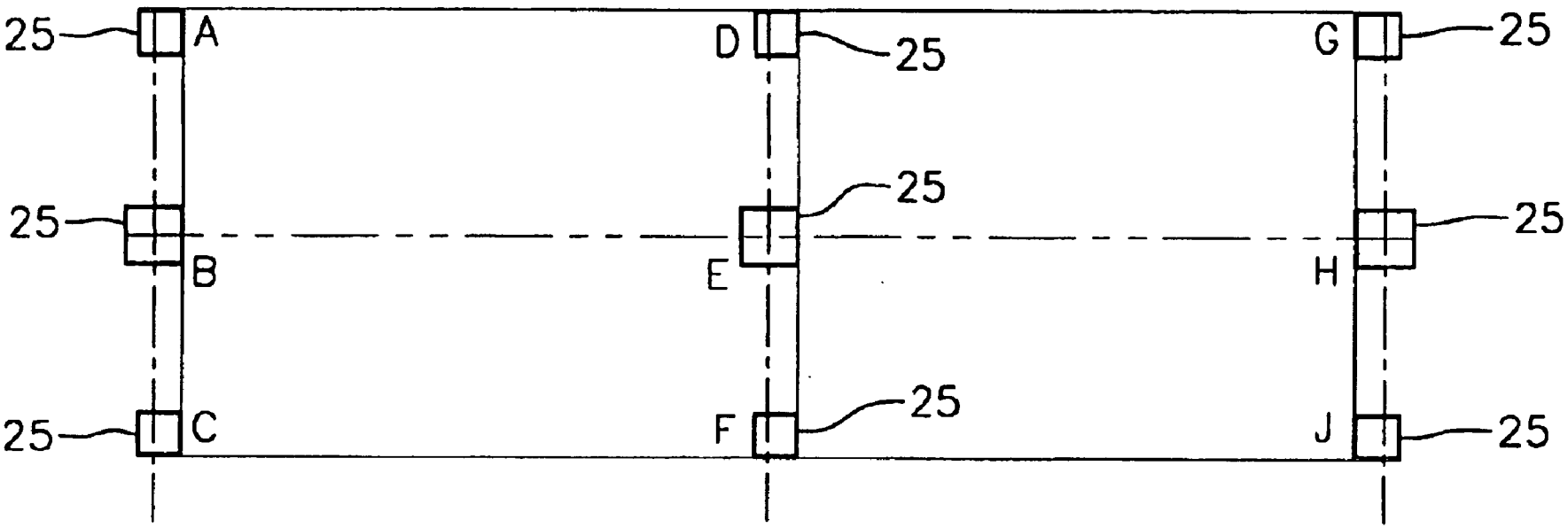
FIG. 3 is a schematic top plan view of the arrangement of the major vertical structural columns which are components of the horizontal racker.
Figure 4:
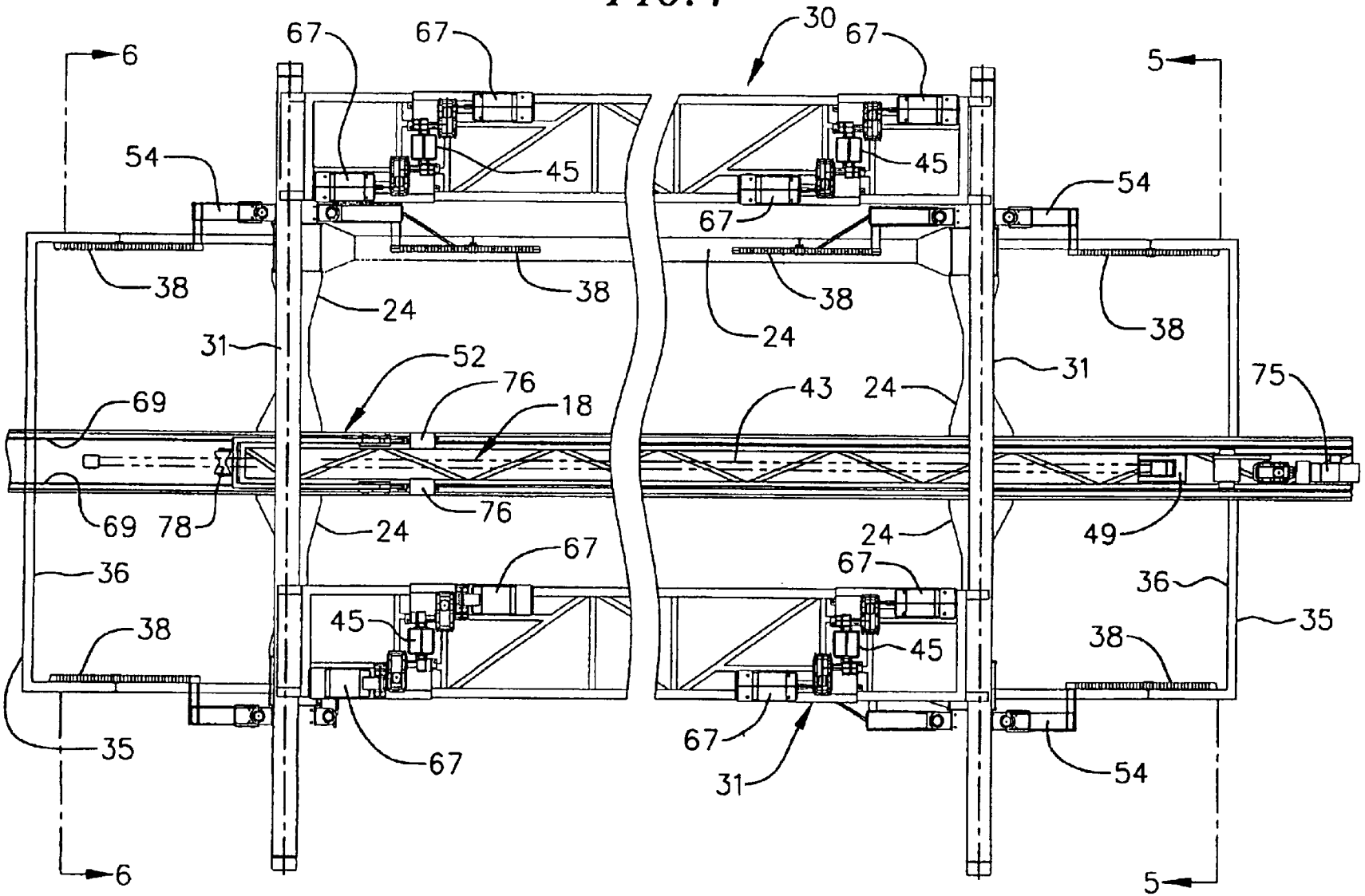
FIG. 4 is an enlarged top plan view of the forward and rear portions of the horizontal pipe racker which also is shown in FIG. 2B.

Pin cart 49 is a small carriage which is captive to and moves in tracks atop and along the length of the skate cart. The skate cart is shown in FIGS. 2B and 9 at its forward limit of travel along the skate cart; the skate cart also is at its forward limit of travel. The pin cart is shown in FIG. 10 at its rearward limit of travel along the skate cart within the lengthwise extent of low lift mechanism 52. The pin cart is driven along the skate cart by a drive motor 75 which preferably is located at the forward end of the skate cart and preferably is an electric motor. Motor 75 preferably is coupled to the pin cart by a cable loop which is arranged for powered movement of the pin cart in either direction along the skate cart. The pin cart defines a rearwardly and upwardly open receptacle into which the pin end of pipe stand 43 can fit. The pin cart is capable of accepting a substantial vertical load from a pipe stand as the stand moves from a horizontal position on the skate to a nearly vertical position in the derrick, or vice versa The pin cart drive preferably includes a brake and an overrunning clutch which permits the pin cart to be moved, by a pipe stand engaged with the cart, at a speed different from the cart speed corresponding to the operation of the pin cart drive motor.

At its extreme rear end, the skate cart carries low lift mechanism 52. The low lift mechanism is provided to raise the rear box end of a pipe stand from the skate cart, as the skate cart approaches the rig floor, an amount which is adequate to place the stand box end above the pipe stop adequately that the stand box end can be reached by elevators for lifting into the rig derrick. The box end of the stand is then engaged by the pipe elevators which are supported by the rig's traveling block, e.g. The traveling block and the elevators are used to raise the stand box end into the derrick as the stand's pin end is moved by the pin cart, or by the pipe stand itself, further toward the rig floor. The low lift mechanism is retracted (lowered) when the box end of the stand has been lifted from it, so that the rear end of the low lift mechanism can pass beneath the pipe stop toward the center of the rig floor (see FIG. 1A).

The presently preferred low lift mechanism preferably is pneumatically powered and preferably includes a pair of pneumatic rams 76; see FIG. 10, e.g. The rams 76 are mounted to the skate cart sides on opposite sides of the pin cart path of movement. Each ram is connected to a crank arm 79 which is coupled to a corresponding one of two lift arms 77 so that extension and retraction of the rams causes the rearmost ends of the lift arms to raise and to lower. The preferred coupling between crank arms 79 and lift arms 77 are meshed gear sectors carried by each of the arms concentric to the pivot axes of the arms. The rear ends of the lift arms mount between them a pipe support roller 78, rotatable about a horizontal axis, which preferably has a linearly tapered hourglass configuration. The lowered position of roller 78 is defined to support a pipe stand on the skate cart at a location on the stand adjacent the stand box end. As the support roller is raised to lift the stand box end from the skate cart, its profile acts to keep the pipe stand positioned along the centerline of the skate cart. The low lift mechanism is operable in a reverse manner to lower to the skate cart the box end of a pipe stand being transferred from the derrick to the pipe racker for storage.

As shown in FIG. 8, e.g., the structure of the low lift mechanism forward of roller 78, i.e., between the roller and rams 76, is arranged on the opposite sides of the skate cart clear of the pin cart's path of movement. As a result, the pin cart 49 can move within the length of the low lift mechanism to the extreme rear end of the skate cart. The pin cart can be positioned within the perimeter of the rig floor closely adjacent to pipe stop 130 when it and the skate cart are at their rearward limits of travel.

In addition to the pipe stabber 73 at the forward margin of the rig floor 17 to handle a pipe stand moving between the rig floor and pipe racker 11, a high lift mechanism 80 also is present there, preferably attached to the pipe stabber. Also there, adjacent to the pipe stabber, and also on the opposite side of the path along which the pipe stand moves, is a pipe guard 132 to contain pipe in the pipe path. See FIGS. 15 and 16. The high lift 80 can be used to advantage during drilling operations. During drilling operations, the drill pipe string can be held by a top drive unit which rotates the drill string and which holds the drill string at an essentially constant load at the drill bit by means of vertical motion compensation equipment known to the offshore drilling industry. This constant bit load can be maintained even as the ship heaves up and down in the seas. When it becomes necessary to add more pipe to the drill string, the drill pipe is seated into slips in a rotary table and disconnected from the top drive. The top drive is raised to the top of the derrick with the next stand of pipe in its elevators. When the new stand of pipe is vertical, it is lowered into the box end tool joint at the top of the drill string, whereupon drilling may continue. In order to prevent the drill bit from striking the bottom of the well while it is suspended in the slips without motion compensation, the pipe string is raised about 15 feet above the drill floor before being set in slips. The high lift can be used to elevate the drill pipe box end from the low lift level to a greater height where the top drive elevators can reach it.

Figure 15:
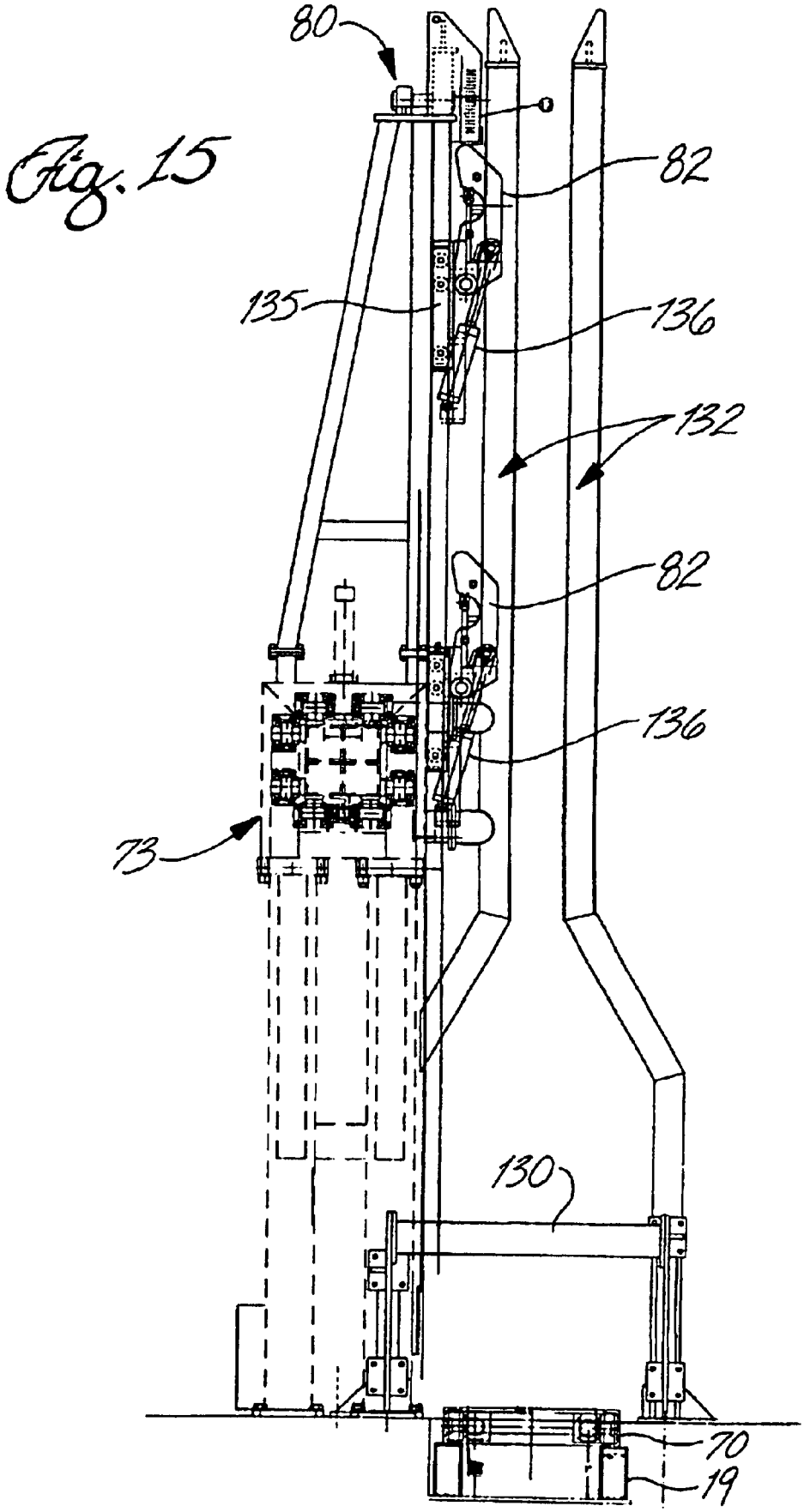
FIG. 15 is an elevation view looking forward along the path of movement of the skate cart at the drill floor of the drilling rig, and shows a pipe stabber and a pipe stand high lift mechanism which has its pipe engaging arm disposed in a retracted position.
Figure 16:
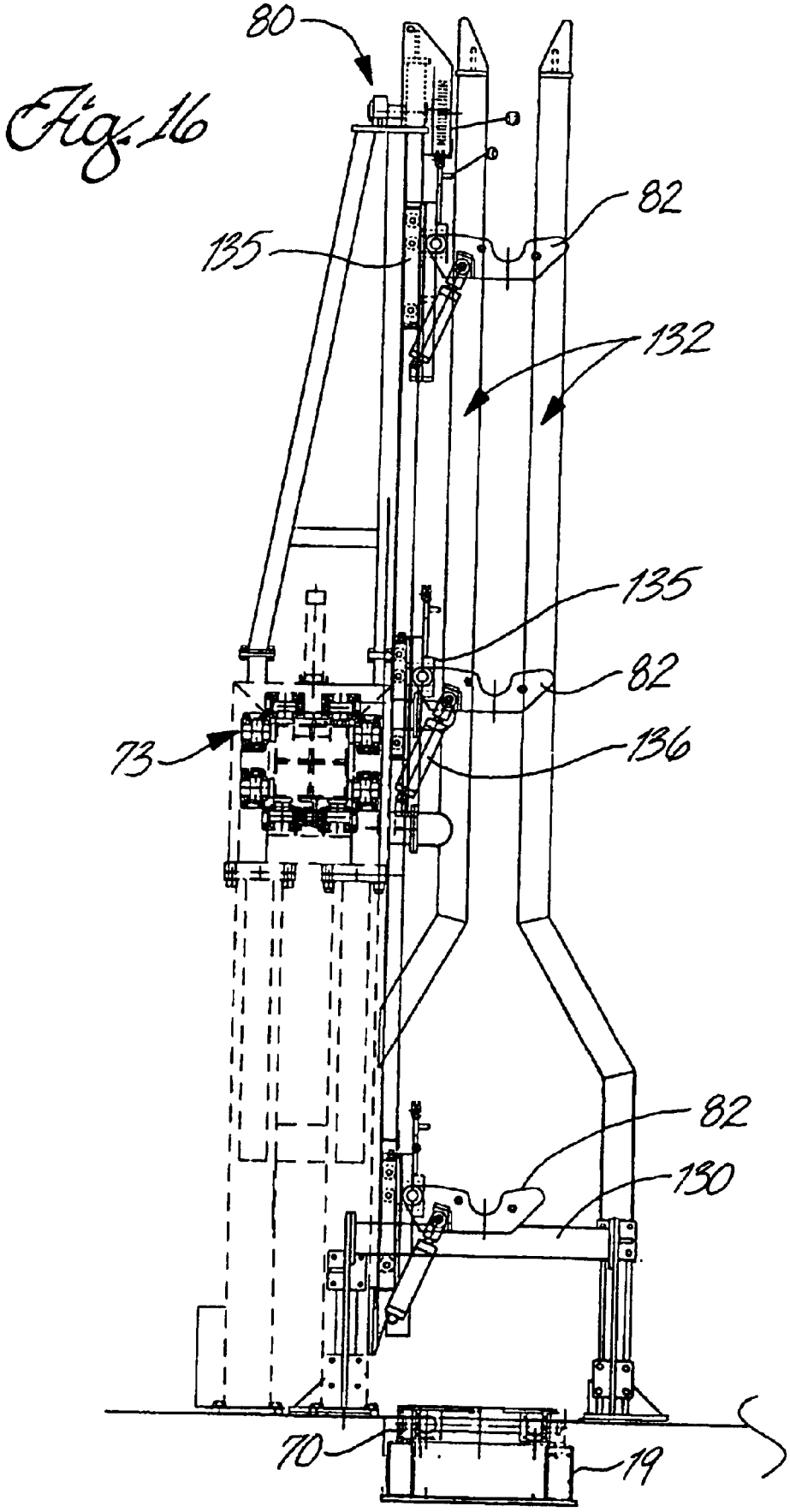
FIG. 16 is a view similar to FIG. 15 and shows the pipe engaging arm of the high lift mechanism deployed into its working position.

The high lift has a carriage 135 which is raised and lowered preferably by a pneumatically driven chain. FIG. 15 shows carriage 135 in upper and intermediate positions while FIG. 16 shows the carriage at upper, intermediate and lower positions. The carriage can have an arm 82 which will articulate from a vertical, upright position down to a horizontal position, and a pneumatic ram 136 to rotate the arm from one position to the other. The arm is connected in a manner that a pipe striking the arm from below will raise the arm. When a pipe is lowered onto the arm from above, the arm is stopped in the horizontal position and holds the pipe in the cradle on the arm.

The high lift is normally stowed in the upmost position with the arm rotated to the vertical position out of the way of pipe being tripped in or out of the well. When the full length of the drill string is in the well and drilling, the high lift carriage is lowered to the lowest most position and the arm 82 is rotated to the horizontal position where it remains until the pipe skate cart is moved aft with the next stand of drill pipe.

FIGS. 1, 2, and 7 illustrate the provision of walkways 84 and ladders 85 on the racker to afford access of personnel to it.

A second form of the sleeper indexing arrangement, somewhat different from the arrangement described above with reference to FIGS. 11 and 11A, is illustrated in FIGS. 17–20 and is presently more preferred. A vertical shaft 60 is associated with each group of sleepers 38 at each sleeper station of each pipe storage bay. Each shaft 60 is located adjacent the forward or aft outboard corner of a racker column 25, as appropriate. Each shaft 60 is supported for rotation and axial movement in a series of bearings 90 which are spaced along the shaft and are mounted in brackets 91 (see FIG. 20) affixed to the adjacent racker columns 25. Each bracket 91 and bearing 90 is located below the downward limit of travel of a respective sleeper base 54 and defines that limit. Just above each such bracket 91, the shaft is traversely notched at diametrically opposed locations to define a pair of horizontal keyway slots 63. A fork 62 is mounted for slidable movement within the sleeper base. The sleeper base has a terminal hub 57, which surrounds the shaft and mounts the base to the shaft for rotation about and axial movement along the shaft. The fork is reciprocated in the sleeper base by a double-acting ram 61. The fork thus is moveable by the ram 61 into and out of engagement with the vertical shaft 60 at the keyway slots 63. Engagement of a fork 62 in keyway slots 63 of a shaft 60 releasably connects the corresponding sleeper base and hub to the shaft so that the base and hub follow axial and angular motion of the shaft.

Each vertical sleeper indexing drive shaft 60 is rotatably supported vertically at its bottom end on a pedestal or platform 92 defined at the upper end of the piston 93 of a vertically disposed ram 94 located below the shaft; see FIG. 18. That ram is operated to raise and to lower the corresponding shaft. Also, there is a shaft angular drive assembly 95 coupled to each vertical shaft above the corresponding vertical drive ram. Each assembly 95 preferably includes a crank arm 96 affixed to the shaft and a double-acting horizontally disposed ran 97 pinned between the end of the crank arm and the racker base 24. The mounting of each horizontal ram 97 between its shaft crank arm and the racker base is arranged to enable the angular drive assembly to accommodate and to follow vertical motion of the shaft by an amount which is adequate to lift a stowed sleeper 38 out of engagement with a sleeper support 64 and adequate to lift a deployed sleeper out of engagement with a deployed sleeper below it.

Figure 19:
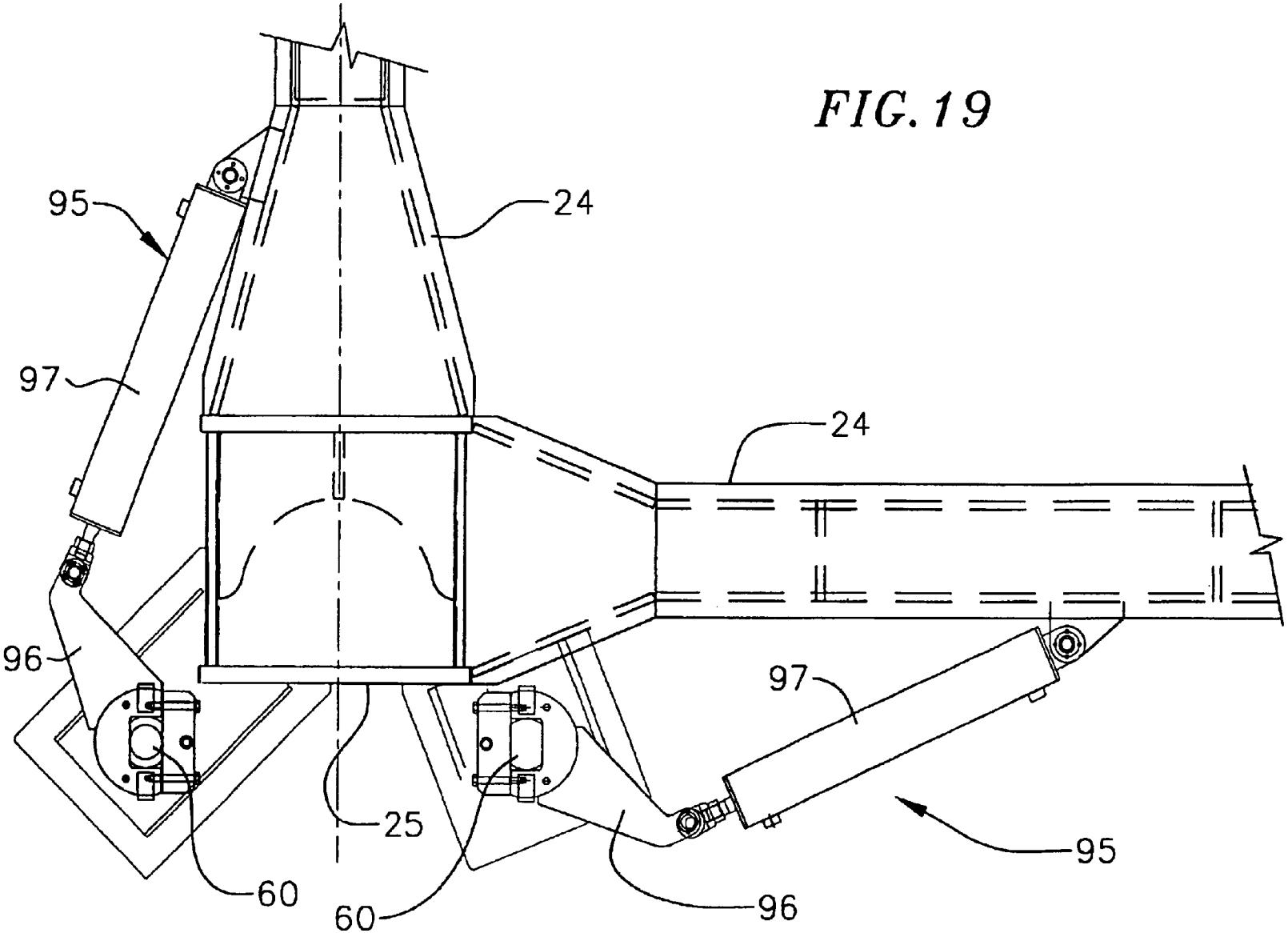
FIG. 19 is a top plan view of the structure shown in FIG. 18.
Figure 20:
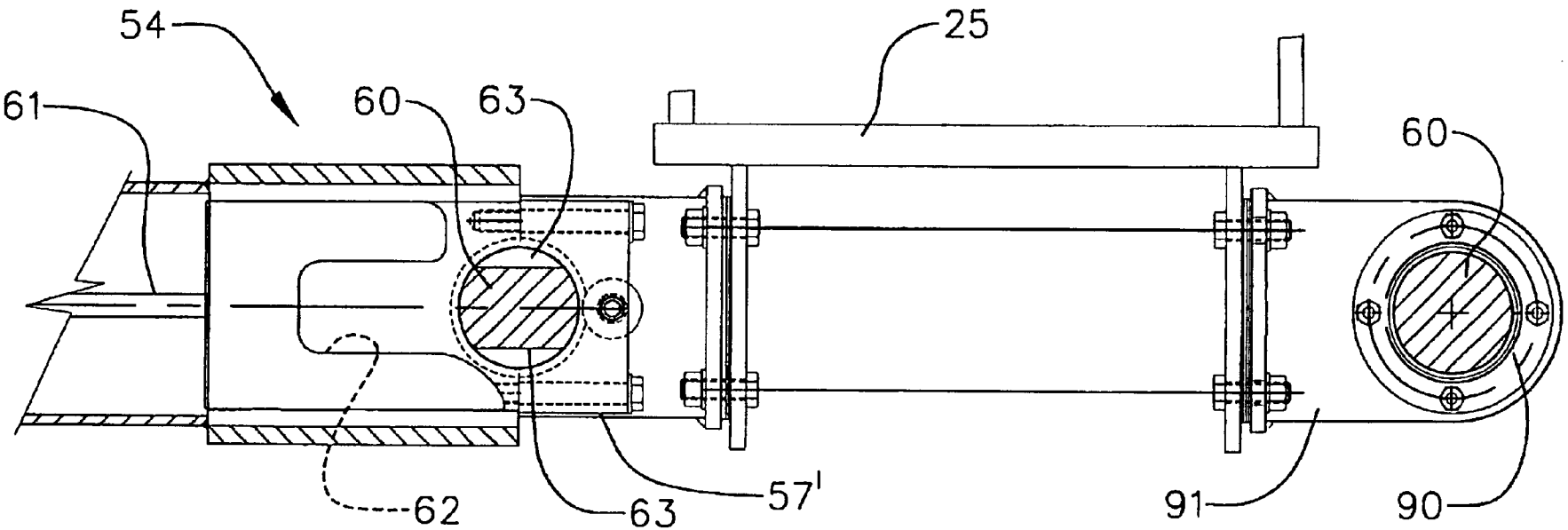
FIG. 20 is a fragmentary top plan view of the hinged end of a sleeper base in the sleeper indexing arrangement shown in FIGS. 17–19.

FIG. 19 shows that the horizontal drive ram 97 for the aftmost shaft associated with a pipe storage bay preferably is located adjacent the rear end of the racker base. The forwardmost horizontal drive ram associated with a pipe storage bay preferably is similarly located relative to the front end of the racker base. All other horizontal drive rams are located adjacent the sides of the racker base.

Figure 17:
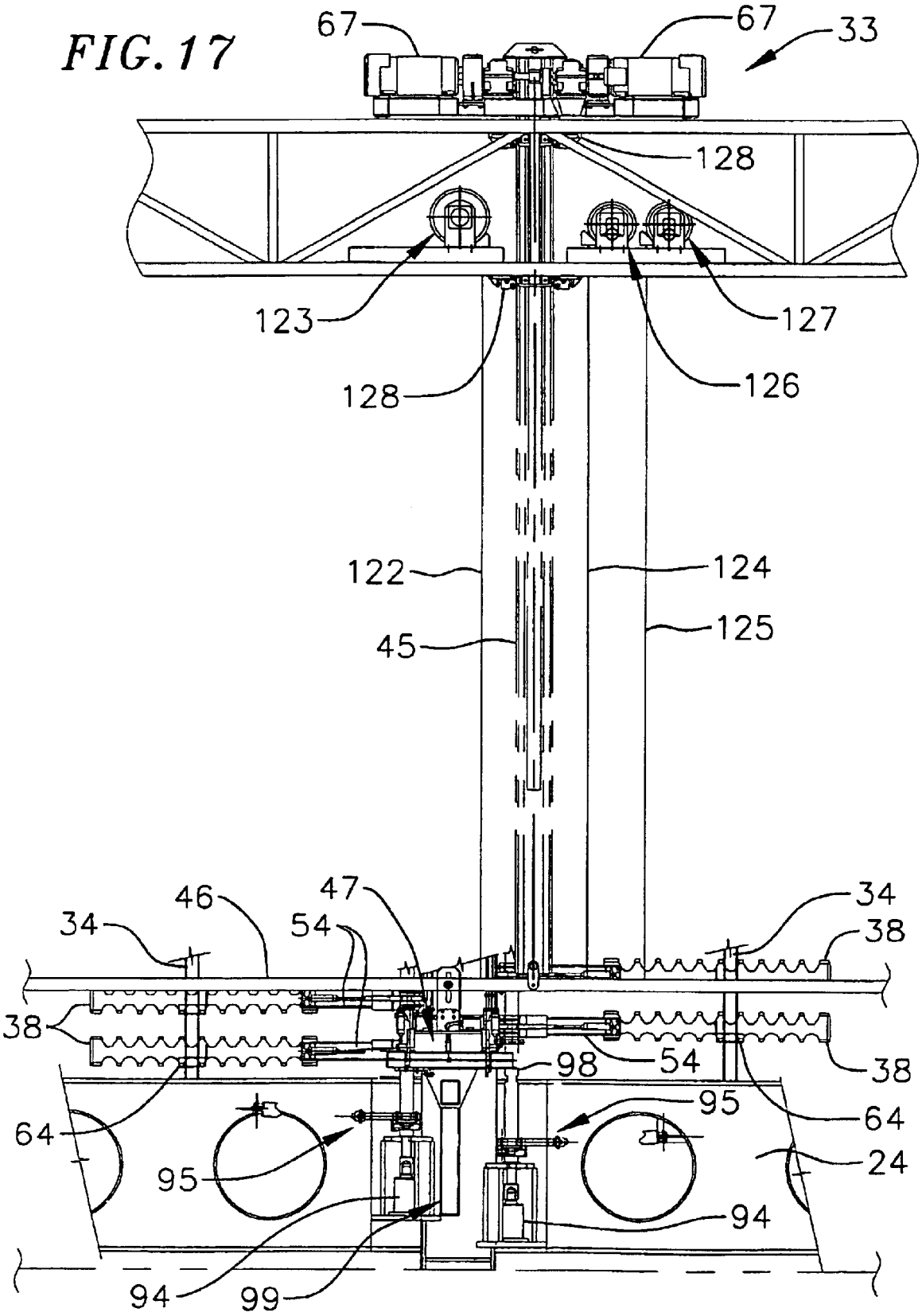
FIG. 17 is a fragmentary side elevation view of the central portion of a racker bridge crane and the racker base below it in the vicinity of the center starboard column of the racker.
Figure 18:
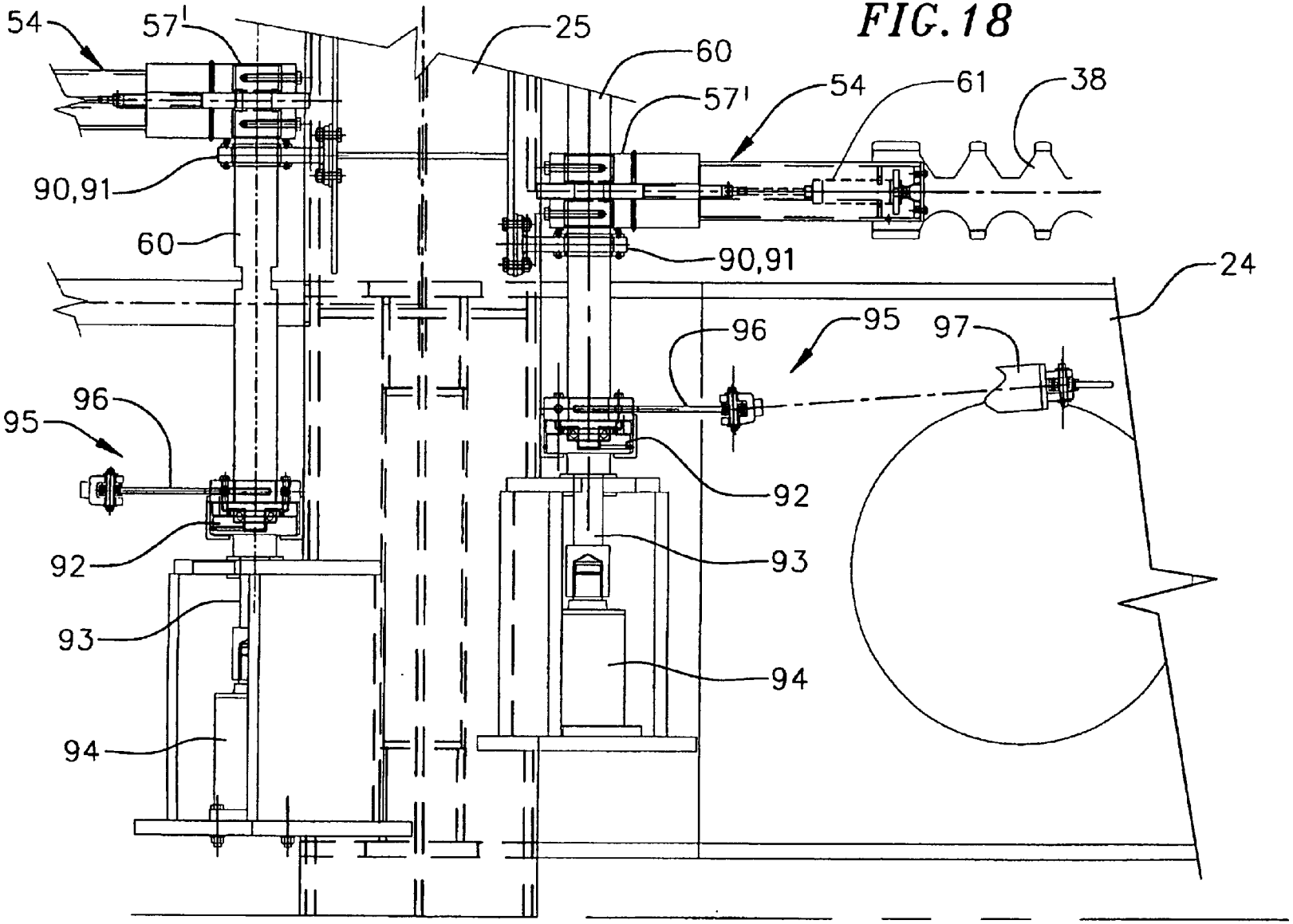
FIG. 18 is an enlarged fragmentary elevation view of the sleeper indexing mechanisms according to FIG. 17 which are associated with the aft starboard main column of the racker.

The operation of the vertical drive and angular drive mechanisms shown in FIGS. 17–19 is according to the six-step sequence described above.

FIG. 17 shows a presently preferred arrangement for securing the lower end of a bridge crane lift column 45 from movement when the lift column is stowed when at its lowest position in the bridge crane. A dummy section 98 of drill pipe is supported in a horizontal fore-and-aft position outboard of the adjacent vertical 94 and angular 95 drives for a sleeper indexing drive shaft 60. The pipe dummy section is located vertically below the place occupied by a corresponding magnetic lifting head when a bridge crane is in its stowed position as described above. The dummy pipe section is carried on a support bracket 99 mounted to the outer face of the racker base. The magnetic lift head 47 carried by the lift column can make contact with the top of the dummy pipe section, and a mechanical safety latch 105 associated with the magnetic lift head can be engaged around and below the dummy pipe section. Such forms of contact with the dummy pipe section cooperate to lock the lower end of the lift column to the dummy pipe section. A drill pipe dummy section preferably is provided for each lifting head in each bridge crane at spaced locations along the outboard sides of the racker base.

Figure 21:
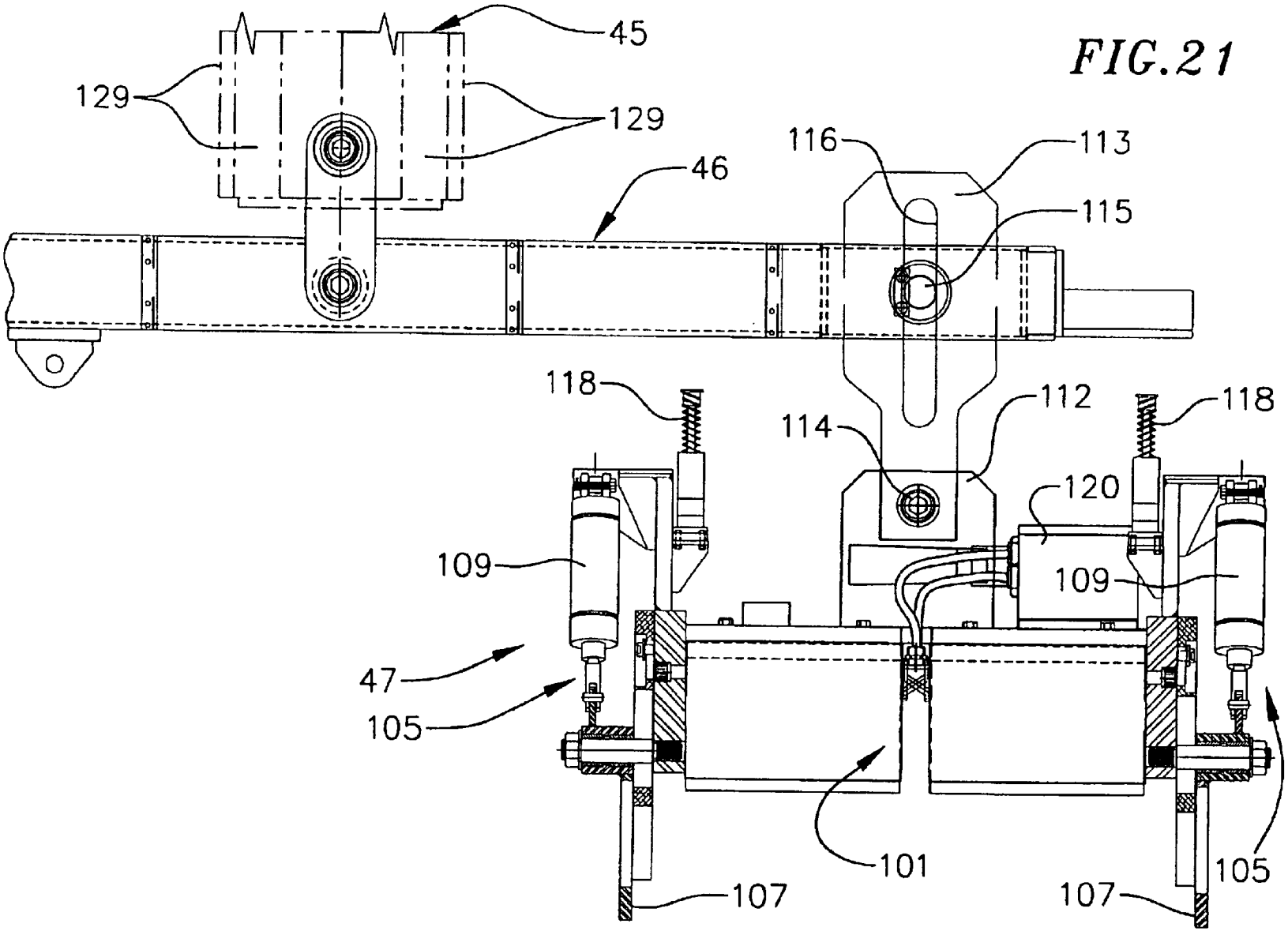
FIG. 21 is a fragmentary side elevation view of a pipe stand lifting head and the adjacent supporting structure in the racker bridge crane shown in FIG. 17.
Figure 22:
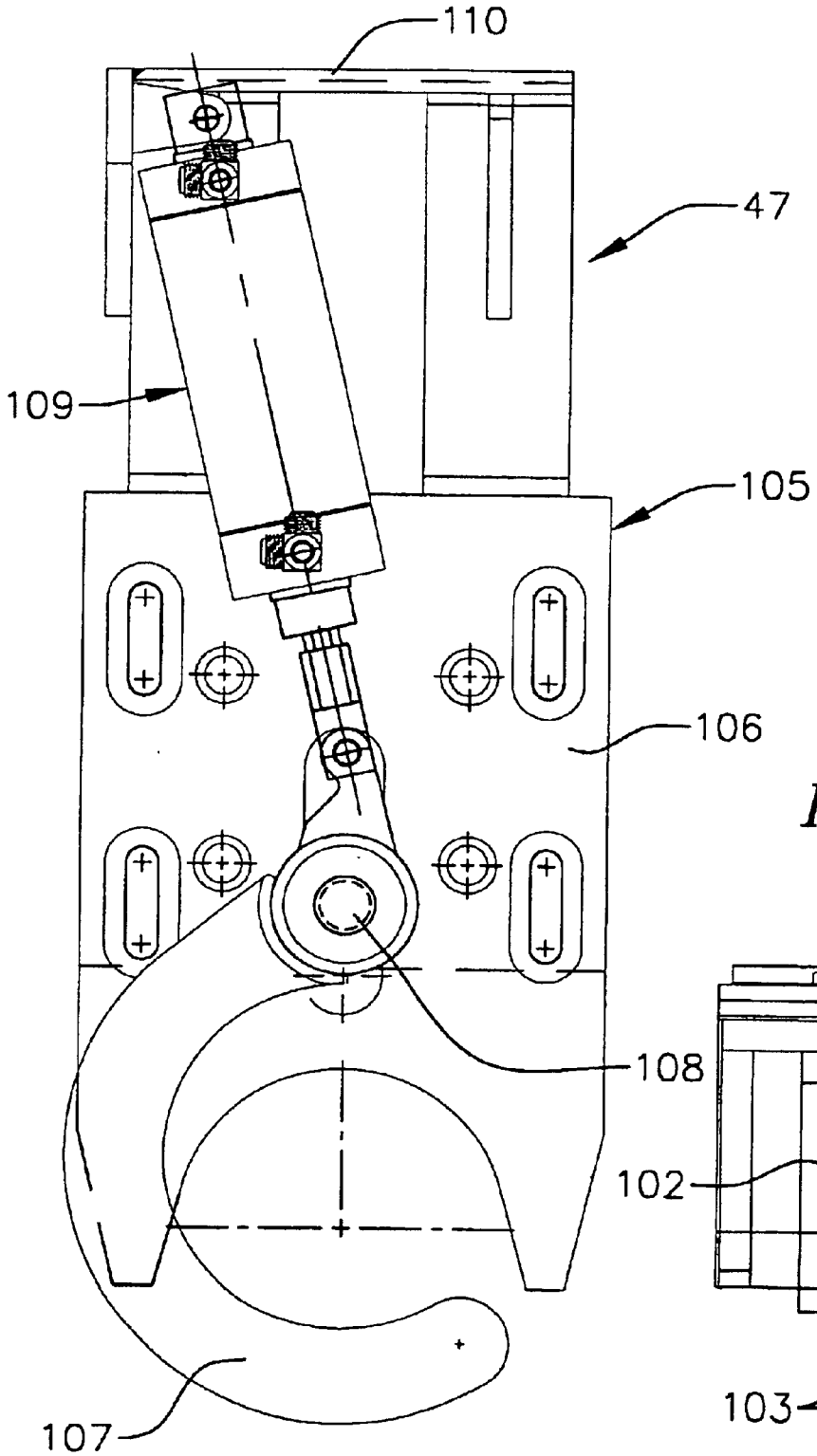
FIG. 22 is an enlarged end view of the lifting head shown in FIG. 21.
Figure 23:
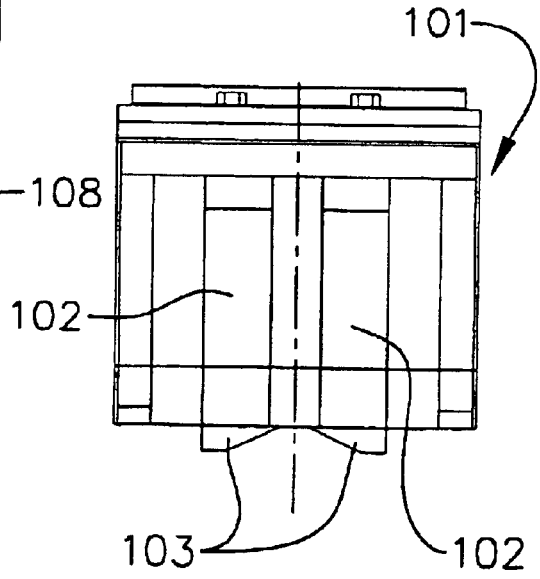
FIG. 23 is an end view of the magnet assembly which is a component of the lifting head shown in FIGS. 21 and 22.

FIGS. 21–23 show details of a presently preferred magnetic lift unit or head 47, several of which are carried by each racker bridge crane spreader bar 46 at spaced locations along the bar. The central part of each lift head is occupied by an elongate magnet assembly 101 (see FIGS. 21 and 23) which includes a pair of slab-like permanent magnets 102. The magnets are in spaced parallel relation to each other and are in planes parallel to the length of the spreader bar. A pipe contact element 103, made of a material which does not interfere with the magnetic field created by the magnets, is replaceably carried by the bottom face of each magnet, as shown in FIG. 23. Each contact element has a sloping or accurately curved face which opens downwardly and also toward the adjacent element 103. The material which defines the pipe contact elements is softer than the metal of the pipe stands 43 to prevent the pipe stands from being scratched by the contact elements. Similarly, all other components of the racker (and also of the skate and pin carts, the low and high lift mechanisms, and the pipe stabber, e.g.) which can or will contact a pipe stand either are made of materials which are softer than the pipe stands, or have their pipe stand contacting surfaces defined by relatively soft and replaceable wear pieces or inserts.

Each lift head 47 preferably also includes a pair of safety latch assemblies 105; see FIG. 22. A latch assembly 105 can include a vertically slidable upperjaw member 106 carried by the adjacent end of the magnet assembly. Each assembly 105 also can include a lowerjaw member 107 which is pivotable about an axle 108 fixed to the magnet assembly and moved about that axle by operation of a double acting ram 109 pinned between a crank arm of a jaw member 107 and a plate 110 carried atop the magnet assembly. The lower jaw member is moved to the side of the bottom recessed end of the upper jaw member when the lift head is being moved into or out of contact with a pipestand, but otherwise is in the position shown in FIG. 22 when the lift head has contact with a pipe stand.

Each lift head assembly 47 can be mounted to its bridge crane spreader bar 46 by a pair of plates 112 and 113. Plate 112 is affixed to the upper central part of the head's magnet assembly 101 and preferably is in a plane parallel to the length of the magnet assembly. Plate 112 can be pinned, as at 114, to a lower tongue of plate 113 which is carried by the spreader bar. Plate 113 can be pinned, as at 115, to the spreader bar via a vertical slot 116 in that plate. In view of the pinned connection between plates 112 and 113, the lift head 47 can pivot about pin 114 and adjust itself to the attitude of a pipe stand being picked up either from a pipe storage bay or from the skate cart. Also, the slidable lost-motion connection of plate 113 to the spreader bar allows the connection of the lift head to the spreader bar to accommodate downward movement of the spreader bar after the lift head has made contact with a pipe stand. Preferably a shock absorber 118 is provided at each end of a lift head 47 to cushion movement of the spreader bar toward the lift head. The shock absorber can be a dashpot whose piston shaft is urged upwardly by a compression spring engaged between the upper end of the shaft and the dashpot body; see FIG. 21.

Each latch assembly 105 (see FIG. 22) is a backup mechanical holder and safety mechanism in the lift head; it is not relied upon, during normal operation of system 10, to support a pipe stand being transported by a racker bridge crane. The several magnet assemblies carried by a bridge crane are intended to hold a pipe stand in the crane. As noted above, the magnetic forces which hold a pipe stand in a bridge crane preferably are generated by permanent magnets. An electrically powered and selectively operable degausser 120 is included in each lift head. The degausser is operated to null the field created by the permanent magnets when a pipe stand is to be released from a bridge crane or is to be picked up by the crane.

Electrical and pneumatic power is supplied to the lift heads of each bridge crane from the crane body. An electrical power cable 122 is connected between a reel 123 on the crane body and the crane spreader bar 46, as shown in FIG. 17. Compressed air supply 124 and return 125 lines are connected from reels 126 and 127 on the crane body to the spreader bar.

As also shown in FIG. 17, a pair of guide roller arrays 128 are carried in the top and bottom of the truss-like body of each bridge crane in cooperation with each crane lift column 45. There preferably are eight rollers in each array, and they engage a corresponding wear bar 129 (see FIG. 22) which extends along the length of the lift column. The lift columns preferably are square in cross-section. There preferably is a wear bar 129 along each corner margin of each face of a lift column. The guide roller arrays cooperate with the lift columns to constrain and hold the columns stiff against pendulous motions relative to the crane body and to move essentially only normal to the bridge crane. Such pendulous motions interfere with the ability of the crane to pickup and deliver a pipe stand from and to a specified aligned set of sleeper notches 41 in a desired storage bin. The presence of the wear bars on the lift columns also reinforce and stiffen the lift columns themselves.

The structures and mechanisms of a presently preferred pipe storage and handling system are constructed for operation in the temperature range of 14° F. to 100° F. (−10° C. to 38° C.). Those structures and mechanism reflect three different sets of environmental conditions, namely; operating conditions in which heave motions of +/−3.7 meters at 8 second period, roll motions of +/−4° at 12 seconds, and pitch motions of +/−4° at 9 seconds, are tolerable; waiting on weather conditions (in which system components are stowed in their normal secure and stowed positions) of +/−6.0 meters heave at 9 seconds, +/−10° roll at 12 seconds, and +/−6° pitch at 10 seconds; and survival conditions (sea fastenings in place or engaged) of +/−8.3 meters heave at 10 seconds, +/−35° roll at 15 seconds, and 10° pitch at 10 seconds. Also, the system components are sized to withstand loads associated with drillship motions during transit of 36 feet heave, 25° roll and 10° pitch at periods of 13–15 seconds.

The design operating rate of the system is one 5000 pound triple pipe stand per minute, both for delivery of stands to the drill floor and removal of stands from the drill floor, using both bridge cranes in synchronism. The bridge cranes have a nominal working speed of 60 to 75 feet per minute when fully loaded, and also a low speed mode in the range of 2 to 4 from when subjected to side forces of 0.5 g opposing crane motion. When subjected to opposing side loads in the range of 0.5 to 1.0 g, the crane drives may stall but they hold the cranes in position. The vertical drive mechanisms of the cranes have a nominal operating speed of 75 to 90 feet per minute, with a slow speed mode in the range of 3 to 5 fpm useful when opposing dynamic loads of +/−0.5 g are present due to ship motion. The crane vertical drives may stall but they hold the vertical position when subject to opposing dynamic forces from 0.5 to 1.0 g. Horizontal and vertical drive mechanisms in the cranes have brakes which lock the crane components in position when not being actively driven by an operator or by the control system; the crane brakes are effective under both operating and waiting on weather conditions.

The bridge cranes can be operated from either one of two control stations. A primary control station 138 is provided in the driller's house 139 at the drilling rig floor; see FIG. 2A. That station is called the pipe handling control console. A secondary control station 140, called the pipe racker control console, is located on a platform 141 adjacent the forward end of the skate cart truss; see FIG. 2B. During normal operation of system 10, the cranes are operated from the primary control station in the automatic mode. The cranes are operable in either a manual mode or the automatic mode from the secondary control station. If a crane is not selected for operation, it is stowed in its parking position outboard of the pipe storage bays. The crane controls include a zone control feature which prevents a crane from hitting structure in either operating mode. Control interlocks prevent a crane from hitting the skate with a pipe when the skate is in motion. When operating in the automatic mode, the crane halts above the transfer position of the skate; a manual command is required to lower or retrieve pipe to or from the skate. When a pipe stand is released or retrieved at the skate, the crane's automatic cycle resumes to pick up or stow the next stand of pipe from or in the desired pipe storage bay.

Relevant control system interlocks are a crane interlock which prevents the cranes from running into each other, a skate interlock which halts the crane above the skate track until a manual command is given to the crane, a sleeper interlock which prevents a crane from lowering its pipe lifting heads to pick up height over the sleepers until the proper sleepers are in the correct position for the operation, and the structural zone interlock described above.

Controls for the sleeper indexing mechanisms preferably are located at the forward secondary control console which is so positioned that the operator can see clearly into both pipe bays or can move easily to see into either of them. The sleeper-related controls at that console preferably include controls for the following functions: select port or starboard bay, select drill pipe layer (1, 2, 3, . . . ), stowed or deployed position of the sleepers for each pipe layer, commanding stow or deploy sleeper motion, an alarm (sound and light) which indicates that one or more sleepers did not respond to a positioning command, and a sleeper lock useful when personnel are present on racked pipe stands. The sleeper stow and position commands signals preferably are also provided to the crane control programming pertinent to the sleeper control interlock.

The skate cart and pin cart drive rates are defined consistent with the one per minute pipe stand delivery/recovery rate. The skate drive preferably is operable to produce skate speeds up to 450 feet per minute and to accelerate from a dead stop to fall speed in 4 seconds. The pin cart drive preferably is operable to produce pin cart speeds up to 600 feet per minute, and to accelerate the pin cart when unloaded from a dead stop to full speed in 2 seconds. The pin cart drive forces the pin cart into contact with the pin end of a pipe stand while the stand is being raised by the derrick elevators without pushing the stand through the elevators. As noted above, an overrunning clutch in the pin cart drive enables the pin cart to overrun its drive in response to loads on the cart by a pipe stand being placed on the skate cart. The skate cart and pin cart drives preferably are of the variable speed kind. The skate cart can make a 112 foot round trip in one minute on a continuous basis. The pin cart travel is about 80 feet along the skate cart. Its drive can return the empty pin cart to its receiving position in 30 seconds. A brake for the skate cart can stop the skate cart in two seconds once per minute when loaded and twice per minute when unloaded. A pin cart brake can halt the pin cart from full speed in one second, and can effect two braking operations per minute on a continuous basis. There are shock absorbers at the limits of travel of the skate and pin carts. The skate and pin cart drives are controllable from primary control station 138.

Controls for operating pipe low lift mechanism 52, pipe stabber 73 and pipe high lift mechanism 80 are located at primary control station 138. The high lift mechanism can lift the box of a pipe stand to an elevation of 22 feet above the rotary table located in the drilling floor at the drilling axis. The low and high lift mechanism can lift 2500 pounds. The low lift operating rate is 4 feet per second. The high lift operating rate is 2 feet per second.

Further information about the control functions and equipment of the presently preferred system 10 are set forth in Tables I and II, pertinent to control stations 138 and 140, respectively.

The information set forth in the foregoing description and in the accompanying Figures and Tables is not exhaustive of all forms which structures and procedures according to this invention may take. Variations and modifications of the described structures and procedures will occur to persons skilled in the relevant arts and technologies, and they are within the fair scope and meaning of the following claims.

TABLE I

Control Functions and Operator Interfaces for the Pipe Handling Control Console

| Control Function | Operator interface | Action/Response | Priority |
|---|---|---|---|
| Skate Drive | Proportional Joystick | Left-Skate moves left<br>Center-Skate Stops<br>Right-Skate moves right | Primary Control (Duplicate) |
| Skate Emergency Stop | Push-pull button | Push-Set Skate brake<br>Pull-Release skate brake | Primary Control Shared (Duplicate) |
| Pipe Lifter | Push and hold buttons | Push "UP"-raise lifter<br>Release "UP"-stop<br>Push "DOWN"-Lower lifter<br>Release "DOWN"-stop | Primary control (Singular) |
| Pipe Stabber | Proportional Joystick and rocker switch control buttons | Left-Stabber Extends<br>Center-stabber stops<br>Right Stabber retracts<br>Depress Lt. Button "O"-Jaws open<br>Depress Button "C"-Jaws close | Primary control (Singular) |
| High Lift | Push and hold buttons | Push "UP" - Lifter raises<br>Push "DOWN"-Lifter lowers | Primary control (Singular) |
| Port Bridge Crane pipe pickup & release | Push and hold Buttons and rocker switch | Push "UP" to raise crane<br>Release "UP" to stop<br>Push "DOWN" to lower crane<br>Release "DOWN" to stop<br>Rock to "P" - Pick pipe<br>Rock to "R" - Release pipe | Primary control (Duplicate) |
| Stbd Crane pipe pickup & release | Push and hold buttons and rocker switch | Push "UP" to raise crane<br>Release "UP" to stop<br>Push "DOWN" to lower crane<br>Release "DOWN" to stop<br>Rock to "P" - Pick pipe<br>Rock to "R" - to release pipe | Primary control (Duplicate) |

TABLE II

Control Functions and Operator Interface for the Pipe Racker Control Console

| Control Function | Operator Interface | Action/Response | Priority |
|---|---|---|---|
| Skate Drive | Proportional Joystick | Left-Skate moves left<br>Center-Skate Stops<br>Right-Skate moves right | Backup Control Maintenance (Duplicate) |
| Skate Emergency Stop | Push-pull button | Push-Set Skate brake<br>Pull-Release skate brake | Primary Control Shared (Duplicate) |
| Port Bridge Crane pipe pickup & release at skate | Push and hold buttons and rocker switch | Push "UP" to raise crane<br>Release "UP" to stop<br>Push "DOWN" to lower crane<br>Release "DOWN" to stop<br>Rock to "P" - Pick pipe<br>Rock to "R" - to release pipe | Backup control Pipe Transfer Maintenance (Duplicate) |
| Stbd Bridge Crane pipe pickup/ release at skate | Push and hold buttons and rocker switch | Push "UP" to raise crane<br>Release "UP" to stop<br>Push "DOWN" to lower crane<br>Release "DOWN" to stop<br>Rock to "P" - Pick pipe<br>Rock to "R" - to release pipe | Backup control Pipe Transfer Maintenance (Duplicate) |
| Port Bridge Crane side to side and vertical movement | Proportional Joystick (Two speed push and old button optional) | Center-crane stops<br>Push port-Move port<br>Push stbd-move stbd<br>Push away - lower<br>Pull to - raise | Backup manual control (Duplicates automatic control) |
| Stbd Bridge Crane side to side and vertical movement | Proportional Joystick (Two speed push and hold button in place of joy stick optional) | Center-crane stops<br>Push port-Move port<br>Push stbd-move stbd<br>Push away - lower<br>Pull to - raise | Backup manual control (Duplicates automatic control |
| Port Bridge Crane pipe pick-up and release in racker | Two position rocker switch | Rock to "P" - pick pipe<br>Rock to "R" - release pipe | Backup manual control (Duplicates automatic control) |
| Stbd Bridge Crane pipe pick-up and release in racker | Two position rocker switch | Rock to "P" - pick pipe<br>Rock to "R" - release pipe | Manual Operation Primary Control (singular) |
| Port Bay Sleeper Level Selection | 18 (17) count selector switch | Position to sleeper level | Backup manual control (Duplicates automatic control) |
| Stbd Bay Sleeper Level Selection | 18 count selector switch (May be incorporated with Set/Stow switches | Position to sleeper level | Backup manual control (Duplicates automatic control) |
| Port Sleeper Set/Stow | Rocker Switch | Rock to "Stow" - Sleepers stow<br>Rock to "Set" - Sleepers set | Backup manual control (Duplicates automatic control) |
| Stbd Sleeper Set/Stow | Rocker Switch | Rock to "Stow" - Sleepers stow<br>Rock to "Set" - Sleepers set | Backup manual control (Duplicates automatic control) |
| Mode Selection | Rocker Switch | Rock to "Automatic" - Automatic control Rock to "Manual" - Manual control | Primary Control (Singular) |
| Automatic Control | PLC control | Automatically operates port and stbd cranes from racker to transfer position | Primary Control (Duplicates all manual operations which duplicate automatic control functions |

What is claimed is:

1. A drill pipe storage apparatus comprising:

a pipe storage bin, horizontal pipe support members disposable in the bin at plural spaced stations along the length of the bin for individually supporting plural horizontal lengths of drill pipe in an array of plural vertically spaced stationary layers and of plural lengths of drill pipe in each layer, and selectively operable drive mechanisms connected to the pipe support members and operable to move the members individually between deployed substantially fixed positions in which the support members are in the array and horizontal retracted positions in which the support members are removed from the array.

2. Apparatus according to claim 1 in which the pipe support members are arranged to support the pipe lengths without subjecting any pipe length to loads due to pipe and support members thereabove in the array.

3. Apparatus according to claim 1 in which the lowermost support member at each station is carried on a bin base, and each other support member at the station when disposed in the array is engaged with and supported on the support member below it.

4. Apparatus according to claim 3 in which the pipe support members when engaged with each other are keyed against relative movement in directions along pipe lengths supported in the bin.

5. A drill pipe storage apparatus comprising:

a pipe storage bin, horizontal pipe support members disposable in the bin at plural spaced stations along the length of the bin for individually supporting plural horizontal lengths of drill pipe in an array of plural vertically spaced layers and of plural lengths of drill pipe in each layer, the lowermost support member at each station being substantially immovable, and each other support member at the station when disposed in the array being engaged with and supported on the support member below it, each pipe support member defining in an upper part thereof a plurality of upwardly open notches sized in cooperation with the vertically adjacent contour of the support member thereabove in the array to receive in each notch a respective pipe length of selected diameter without contact of the pipe length with the support member directly thereabove, and selectively operable drive mechanisms connected to respective other pipe support members and operable to move the members individually between deployed positions in which the support members are in the array and retracted positions in which the support members are removed from the array.

6. Apparatus according to claim 5 in which the pipe receiving notches have substantially straight sloping sides.

7. A drill pipe storage apparatus comprising:

a pipe storage bin, horizontal pipe support members disposable in the bin at plural spaced stations along the length of the bin for individually supporting plural horizontal lengths of drill pipe in an array of plural vertically spaced layers and of plural lengths of drill pipe in each layer, and selectively operable drive mechanisms connected to the pipe support members and operable to turn the support members about vertical axes located outside the array to move the members individually between deployed positions in which the support members are in the array and retracted positions in which the support members are removed from the array.

8. Apparatus according to claim 7 in which the drive mechanisms are operable to lift and lower the pipe support members.

9. Apparatus according to claim 7 in which the drive mechanisms include at each station a rotatable vertical shaft with which is associated a group of pipe support members, each support member in the group having an end frame through which the shaft rotatably passes, a coupling selectively engageable between each pipe support member and the shaft for securing the shaft from rotation relative to the pipe support member, and a shaft drive operable for rotating the shaft a selected amount in either direction about its axis.

10. Apparatus according to claim 9 in which the shaft is axially movable through each pipe support member, each coupling is operable for securing the associated pipe support member from axial motion of the shaft relative thereto, and the shaft drive is operable for raising and lowering the shaft a selected amount.

11. Apparatus according to claim 9 including a holder for each support member with which the support member is engageable in its retracted position.

12. Apparatus according to claim 9 in which the pipe support members at each station comprises two groups of movable support members, alternate support members being members of a respective group with which is associated a respective one of a pair of vertical shafts.

13. Apparatus according to claim 12 in which the shafts at each station are disposed at a common side of the bin.

14. Apparatus according to claim 12 in which the pipe support members in one group have retracted positions in which they extend in one direction from the station substantially parallel to the array, and retracted pipe support members in the other group extend in an opposite direction from the station substantially parallel to the array.

15. Apparatus according to claim 12 in which the deployed positions of the pipe support members at each station are in a common vertical plane disposed transversely of the array, and each support member above the lowermost one is supportively engaged with the support members below it.

16. A drill pipe storage apparatus comprising:

a pipe storage bin stationary relative to a place of pipe use horizontal pipe support members disposable in the bin at plural spaced stations along the length of the bin for individually supporting plural horizontal lengths of drill pipe in an array of plural vertically spaced layers and of plural lengths of drill pipe in each layer, selectively operable drive mechanisms connected to respective pipe support members and operable to move the members individually between deployed positions in which the support members are stationary in the array and retracted positions in which the support members are removed from the array, and a pipe lifter disposable above the array and operable to move individual pipe lengths in a horizontal attitude between the array and a transfer position laterally of the array.

17. Apparatus according to claim 16 in which the pipe lifter comprises a bridge crane spanning the length of the bin and movable transversely relative to the bin.

18. Apparatus according to claim 16 in which the pipe lifter includes a plurality of controllable magnetic pipe lift units engageable with a pipe length at spaced locations along the length.

19. Apparatus according to claim 18 in which each pipe lift unit comprises plural permanent magnets and a selectively operable degausser.

20. Apparatus according to claim 18 in which each pipe lift unit includes a backup mechanical holder selectively engageable with and releasable from a pipe length.

21. Apparatus according to claim 18 in which the pipe lift units are supported on a common carrier.

22. Apparatus according to claim 21 in which the bridge crane has a stowed position spaced laterally from the bin in which pipe lift units are securable to structures at a lower exterior portion of the bin.

23. Apparatus according to claim 21 in which the common carrier for the pipe lift units is movable vertically relative to the bridge crane via a plurality of column members drivable vertically of the crane.

24. Apparatus according to claim 23 in which the column members have vertically spaced guides in the bridge crane arranged to constrain the column members to motion substantially only normal relative to the crane.

25. Apparatus according to claim 16 in which the bin is spaced in a direction substantially parallel to the length of the bin from a place of use of pipe lengths, and including a pipe delivery mechanism for moving pipe in a horizontal attitude between a transfer position adjacent the bin and the place of pipe use, the pipe delivery mechanism includes a track extending from the transfer position toward the place of pipe use.

26. Apparatus according to claim 25 including an elongate carriage drivable in each of two opposite directions along the track to and from the transfer position, the carriage having a length adequate to support a pipe length in alignment therewith at one end of the pipe length and at a location along the pipe length near its other end.

27. Apparatus according to claim 26 including a cart drivable in each of two opposite directions along the length of the carriage, the cart defining an upwardly open receptacle for receiving and bearing the one end of a pipe length supported on the carriage.

28. Apparatus according to claim 27 including a pipe support roller mounted at the end of the carriage nearest the place of pipe use for rotation about a horizontal axis.

29. Apparatus according to claim 28 in which the roller has a larger diameter in its ends than between its ends.

30. Apparatus according to claim 28 including a selectively operable lift mechanism mounted between the roller and the carriage operable for controllably raising and lowering the roller relative to the carriage.

31. Apparatus according to claim 30 in which the roller lift mechanism is disposed on the carriage out of the path of the cart along the carriage.

32. Apparatus according to claim 25 in which the place of pipe use is a well drilling facility which includes a drilling operations platform.

33. Apparatus according to claim 32 in which the track is substantially coplanar with the drilling operations platform.

34. Apparatus according to claim 32 in which the drilling facility is located on a floatable offshore drilling structure.

35. Apparatus according to claim 34 including a second pipe storage bin disposed in proximate parallel relation to the transfer position.

36. A drill pipe storage and handling apparatus for a well drilling rig comprising:

a track extending from one end adjacent the drilling rig to an opposite end remote from the rig, an elongate carriage adapted to travel along the track and to receive a length of drill pipe disposed longitudinally with respect to the track and to support a received pipe length at spaced locations therealong, a pipe storage bin disposed laterally of one end of the track including horizontal pipe support members cooperatively configured for individually supporting plural lengths of drill pipe in an array of plural vertically spaced layers of pipe and plural lengths of pipe in each layer, the pipe support members above the bottom layer being indexable between deployed positions in and transversely of the array and retracted positions outside the array, a moveable pipe litter disposable above the bin operable to move individual pipe lengths between the array and the carriage.

37. Apparatus according to claim 36 in which the carriage includes a pipe lifter at its end adjacent the drilling rig operable to lift the adjacent end of a received pipe length a selected distance above the carriage.

38. Apparatus according to claim 37 in which each pipe length has a pin end and a box end, the pipe lengths are disposed in the array with their pin ends remote from the drilling rig, and including a cart movable along the carriage adapted for supporting the pin end of a received pipe length.

39. Apparatus according to claim 38 in which the carriage is drivable along the track, and the cart is drivable along the carriage.

40. Apparatus according to claim 36 in which the track and the carriage are common to and are disposed between a pair of similar bins.

41. Apparatus according to claim 40 in which the pipe lifter is operable to move pipe lengths between either bin and the carriage.

42. A method of storing oil and gas well drill pipe comprising the steps of horizontally disposing a selected number of pipe lengths, as a first bottom layer thereof, individually in upwardly open notches in the upper extents of a set of stationary pipe supports disposed transversely of the pipe lengths at stations spaced along the lengths, and horizontally disposing further numbers of pipe lengths in further similarly notched pipe support sets placed at each station atop the supports therebelow to create a stationary array of plural layers of plural numbers of pipe lengths, and raising and lowering individual pipe lengths directly from above from and to receiving notches in the pipe supports.

43. The method according to claim 42 including defining the support members so that each pipe length in the array makes contact only with the surfaces of the upwardly open notches of the pipe supports immediately below it in the array.

44. The method according to claim 42 including the further step of moving each set of pipe supports to retracted horizontal positions out of the array upon removal of all pipe lengths from the layer supported by that set to expose the next lower layer in the array, and moving the next upper set of supports into deployed positions in the array on filling a pipe length layer in the array.

45. The method according to claim 44 in which moving the pipe supports from deployed positions to retracted positions includes raising the deployed supports out of contact with the supports therebelow in the array, swinging each raised support horizontally about an axis at an end of the support, and lowering the raised and swung supports into holders therefor located outside the array.

46. The method according to claim 45 in which moving the pipe supports from retracted positions to deployed positions includes performing the reverse of each of the operations described in claim 45 in reverse sequence.

47. The method according to claim 42 in which raising individual pipe lengths from the pipe supports includes engaging a pipe length from above at spaced locations along the length by a plurality of magnetic lift heads, and raising the lift heads in substantial unison.

48. The method according to claim 42 in which lowering individual pipe lengths to the pipe supports includes horizontally supporting a pipe length from above via a plurality of magnetic lift heads at spaced locations along the pipe length, lowering the lift heads in substantial unison to place the pipe length in aligned notches in a set of pipe supports, and nulling the magnetic fields of the lift heads.

49. A method of storing oil and gas well drill pipe comprising the steps of horizontally disposing a selected number of pipe lengths, as a first bottom layer thereof, individually in upwardly open notches in the upper extents of a set of pipe supports disposed transversely of the pipe lengths at stations spaced along the lengths, and horizontally disposing further numbers of pipe lengths in further similarly notched pipe support sets placed at each station atop the supports therebelow to create an array of plural layers of plural numbers of pipe lengths, and raising and lowering individual pipe lengths directly from and to receiving notches in the pipe supports, raising a pipe length from its pipe supports including moving the pipe length in a horizontal attitude from the array to a state of support on a carriage movable along a path laterally from, adjacent to and parallel to the array, the carriage supporting the pipe length at spaced locations along the pipe length.

50. The method according to claim 49 including raising an end one of the locations of carriage support of the pipe relative to the carriage upon movement of the carriage to a selected place displaced from the array, the selected place being associated with removal of the pipe length from the carriage.

51. The method according to claim 49 in which the carriage has two locations of support of a pipe length disposed thereon, one of which is raisable relative to the carriage, the other of which is movable along the carriage and is adapted to support an end of the pipe length.

52. A method for storing, handling, and moving drill pipe in association with a well drilling rig having a drilling operations floor, the method comprising the operations of:

lifting a stand of drill pipe directly from an individual horizontal storage position in an array of stand storage positions, placing the lifted stand on a carriage arranged to support the placed stand at spaced locations along its length, moving the carriage towards the floor to place one end of the carriage at the floor, elevating the one end of the placed stand above its placed position on the carriage as the carriage nears the floor, and hoisting the stand via the one end thereof to a vertical position above the floor while movably supporting the other end of the stand on the carriage.

53. The method according to claim 52 in which the elevating operation includes raising the location of carriage support of the placed stand which is nearest the one end of the stand.

54. A drill pipe storage apparatus comprising:

a pipe storage bin, horizontal pipe support members disposable in the bin at plural spaced stations along the length of the bin for individually supporting plural horizontal lengths of drill pipe in an array of plural vertically spaced layers and of plural lengths of drill pipe in each layer, and selectively operable drive mechanisms connected to the pipe support members and operable to move the members individually only when empty of drill pipe between deployed positions in which the support members are in the array and horizontal retracted positions in which the support members are removed from the array.

55. A drill pipe storage apparatus comprising:

a pipe storage bin, horizontal pipe support members disposable in the bin at plural spaced stations along the length of the bin for individually supporting plural horizontal lengths of drill pipe in an array of plural vertically spaced layers and of plural lengths of drill pipe in each layer, the lowermost support member at each station being carried on a bin base, and each other support member at the station when disposed in the array being engaged with and supported on the support member below it, each pipe support member defining in an upper part thereof a plurality of upwardly open notches which have substantially straight sloping sides and which are sized in cooperation with the vertically adjacent contour of the support member thereabove in the array to receive in each notch a respective pipe length of selected diameter without contact of the pipe length with the support member directly thereabove, and selectively operable drive mechanisms connected to the pipe support members and operable to move the members individually between deployed positions in which the support members are in the array and retracted positions in which the support members are removed from the array.

* * * * *

UNITED STATES PATENT AND TRADEMARK OFFICE

CERTIFICATE OF CORRECTION

PATENT NO. : 6,926,488 B1
DATED : August 9, 2005
INVENTOR(S) : Bolding et al.

It is certified that error appears in the above-identified patent and that said Letters Patent is hereby corrected as shown below:

Column 26,
Line 1, delete “litter”, insert -- lifter --.

Signed and Sealed this

Fourteenth Day of February, 2006

JON W. DUDAS
*Director of the United States Patent and Trademark Office*

Disclaimer

6,926,488—Vance E. Bolding, Katy; Andrew J. Brooks, III, League City, both of TX (US); Michael D. Keen, Houma, LA (US). HORIZONTAL DRILL PIPE RACKER AND DELIVERY SYSTEM. Patented dated Aug. 9, 2005. Disclaimer filed Dec. 27, 2005, by the assignee, Global Marine Inc.

Hereby enters this disclaimer to claims 52 and 53, of said patent.

*Official Gazette, March 21, 2006*